US007770877B2

(12) United States Patent
Hasegawa

(10) Patent No.: US 7,770,877 B2
(45) Date of Patent: Aug. 10, 2010

(54) SHEET DISCHARGE UNIT AND SHEET PROCESSING APPARATUS

(75) Inventor: Yousuke Hasegawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/386,503

(22) Filed: Mar. 13, 2003

(65) Prior Publication Data

US 2003/0209848 A1 Nov. 13, 2003

(30) Foreign Application Priority Data

Mar. 19, 2002 (JP) ..... P2002-076791
Mar. 6, 2003 (JP) ..... P2003-059973

(51) Int. Cl.
*B65H 85/00* (2006.01)

(52) U.S. Cl. ..... 271/3.14; 271/162; 271/3.01; 271/186; 271/65

(58) Field of Classification Search ..... 271/171, 271/162, 164, 3.01, 3.14, 4.01, 223, 186, 271/207, 65, 189, 130; 399/389, 392, 393, 399/405; 347/104, 105, 106, 16
See application file for complete search history.

(56) References Cited

U.S. PATENT DOCUMENTS 4,279,504 A * 7/1981 Brown et al. ..... 355/72
4,419,007 A * 12/1983 Kingsley ..... 399/85
4,872,659 A * 10/1989 Kato et al. ..... 271/9.01
5,000,596 A 3/1991 Naruki
5,012,295 A 4/1991 Ikkatai et al. ..... 355/311
5,022,640 A * 6/1991 Greco, Jr. ..... 271/3.05
5,094,441 A * 3/1992 Sebileau ..... 271/186
5,111,252 A 5/1992 Hamada et al. ..... 355/308
5,172,903 A 12/1992 Haneda et al.
5,261,651 A * 11/1993 Ishida ..... 271/3.2
5,328,166 A * 7/1994 Hokamura ..... 271/171
5,333,852 A * 8/1994 Milillo et al. ..... 271/171

(Continued)

FOREIGN PATENT DOCUMENTS

CN 1689948 A 11/2005

(Continued)

OTHER PUBLICATIONS

English translation of Japanese Publication No. 3-120125.*

*Primary Examiner*—Patrick Mackey
*Assistant Examiner*—Thomas A Morrison
(74) *Attorney, Agent, or Firm*—Morgan, Lewis & Bockius LLP

(57) ABSTRACT

A sheet supply tray and a sheet discharge tray are provided. Long sheets can be supplied from the sheet supply tray loaded with the long sheets. The sheet discharge tray is used also as the sheet supply tray, and receives the long sheets with a sheet discharge surface thereof in an area facing the sheet loading surface of the sheet supply tray. A discharge guide unit for guiding the discharge direction of the long sheets is detachably provided in such a dual-purpose type sheet discharge unit. A discharge/reception unit supporting the long sheets is detachably provided as a whole or a part of the sheet discharge unit. An extension sheet tray extensible with respect to a standard sheet tray is provided while the extension state of the extension sheet tray can be detected by an extension detection unit.

2 Claims, 33 Drawing Sheets

U.S. PATENT DOCUMENTS

| | | | | | |
|---|---|---|---|---|---|
| 5,409,209 | A | * | 4/1995 | Nakamura et al. | 271/271 |
| 5,537,195 | A | * | 7/1996 | Sagara et al. | 399/381 |
| RE35,341 | E | * | 10/1996 | Kikuchi et al. | 271/3.14 |
| 5,725,207 | A | * | 3/1998 | Deguchi | 271/9.09 |
| 5,940,106 | A | * | 8/1999 | Walker | 347/104 |
| 6,053,493 | A | * | 4/2000 | Yokoyama et al. | 271/171 |
| 6,618,575 | B2 | * | 9/2003 | Takida et al. | 399/367 |
| 2005/0236764 | A1 | | 10/2005 | Saeki et al. | |

FOREIGN PATENT DOCUMENTS

| | | | | |
|---|---|---|---|---|
| JP | 57-51627 | | * | 3/1982 |
| JP | 58-21270 | | * | 2/1983 |
| JP | 61-150939 | | | 7/1986 |
| JP | 61-150939 | A | | 7/1986 |
| JP | 63-104369 | U | | 7/1988 |
| JP | 64-17753 | | | 1/1989 |
| JP | 02-178168 | | | 7/1990 |
| JP | 3-028145 | U | | 3/1991 |
| JP | 3-120125 | | * | 5/1991 |
| JP | 3-235970 | | * | 10/1991 |
| JP | 6-9066 | | * | 1/1994 |
| JP | 6-144598 | | * | 5/1994 |
| JP | 6-179529 | | | 6/1994 |
| JP | 8-026502 | | | 1/1996 |
| JP | 9-002673 | | | 1/1997 |
| JP | 09-151039 | | | 6/1997 |
| JP | 9-151039 | A | | 6/1997 |
| JP | 10-017753 | | | 1/1998 |
| JP | 11-035169 | | | 2/1999 |
| JP | 11-35169 | A | | 2/1999 |
| JP | 2001-019256 | | | 1/2001 |
| JP | 2001-163454 | A | | 6/2001 |

* cited by examiner

SHEET DISCHARGE UNIT AND SHEET PROCESSING APPARATUS

The present disclosure relates to the subject matters contained in Japanese Patent Application No. 2002-076791 filed on Mar. 19, 2002, and in Japanese Patent Application No. 2003-059973 filed on Mar. 6, 2003, which are incorporated herein by reference in its entirety.

BACKGROUND OF THE INVENTION

1. Field of the Invention

The present invention relates to a sheet discharge unit for discharging sheets of paper or the like or a sheet supply unit for supplying sheets, and particularly relates to the improvement of a sheet discharge unit, a sheet supply unit and sheet processing apparatus using these units, which improvement being effective in discharging or supplying long sheets.

2. Description of the Related Art

An example of a sheet processing apparatus is an image forming apparatus using an electro-photographic system or the like.

In such image forming apparatus in the related art, an imaging engine using an electro-photographic system or the like is mounted in an apparatus body so that the imaging engine forms an image. On the other hand, a sheet of paper or the like is supplied from a sheet supply unit to the imaging engine, and the image formed by the imaging engine is transferred and fixed to the sheet. Then, the sheet is discharged to a sheet discharge unit.

In such image forming apparatus, there is a request to use long sheets. To satisfy the request, for example, there is adopted a system in which long sheets are set in a manual sheet insertion type sheet supply unit, and discharged to a discharge tray as a sheet discharge unit after an imaging cycle is performed on the long sheets.

There has been proposed a manual sheet insertion type sheet supply unit in which one stage of an assistant tray or plural stages of assistant trays are provided movably at the rear edge of a manual sheet insertion tray, and a sheet loading surface which can be loaded with long sheets including their rear ends is secured by the manual sheet insertion tray and the assistant tray(s), so that the manual sheet insertion type sheet supply unit can be extended for exclusive use of the long sheets. Such type of sheet supply unit is disclosed in JP-A-2001-163454 (at Mode for Carrying Out the Invention and FIG. 1) and in JP-UM-A-3-28145 (at Example of embodiment and FIG. 1).

However, the length of the discharge tray as a sheet discharge unit is generally fitted to the length of a largest form sheet. Therefore, when a long sheet is discharged, there may occur a problem that a part of the long sheet protrudes from the discharge tray and falls therefrom, or the falling long sheet curls up.

Therefore, of such image forming apparatus, there has been proposed apparatus by which long sheets can be supplied and discharged without increasing the apparatus area.

According to this proposal, there is disclosed in JP-A-6-179529 (at Example of embodiment and FIG. 1) that the image forming apparatus is mounted on a paper supply/discharge unit, and long sheets to be supplied are received in a space secured between the image forming apparatus and the paper supply/discharge unit, while the discharged paper is received on a table for mounting the paper supply/discharge unit thereon.

However, in such image forming apparatus, the sheet reception space for supplying or discharging the long sheets has to be not smaller than the regular running sheet size. Thus, in the related art, it is essential to provide both the space for supplying the long sheets and the space for discharging the long sheets. As a result, the area for installing the image forming apparatus is not increased so much, but a large volume is required for the space for receiving the long sheets.

In addition, a technique in which a lid or a cover of a sheet supply cassette is designed to be drawable so that the drawn lid or the drawn cover is used as a discharge tray of a sheet discharge unit has been proposed in JP-A-8-026502 (at Example of embodiment and FIG. 1) and in JP-A-9-002673 (at Example of embodiment and FIG. 1).

However, the lid or the cover becomes essential for the sheet supply cassette to load discharged sheets thereon so that the cost of parts increases correspondingly. In addition, since the lid or the cover having a function as a discharge tray is drawn from the sheet supply cassette, the length of the discharge tray is restricted to the length of the sheet supply cassette.

Accordingly, sheets to be used have to be received in at least the sheet supply cassette. However, when it is intended to support long sheets of various sizes, it is inevitable to increase the length of the sheet supply cassette. It is therefore difficult to receive the sheet supply cassette in the image forming apparatus body.

Thus, when long sheets are used while the sheet supply cassette is received in the image forming apparatus body, setting of the long sheets in the sheet supply cassette is regarded as difficult so that the current situation almost seems to be that there is no choice but to use a manual sheet insertion tray for setting the long sheets.

Further, in a manual sheet insertion type sheet supply unit supporting long sheets, an assistant tray is added to a manual sheet insertion tray. However, the image forming apparatus itself has no way to judge whether the assistant tray has been added to the manual sheet insertion tray or not. The judgment has to totally depend on a user.

As a result, the following technical problem can be found. That is, for example, when long sheets are intended to be supplied from the manual sheet insertion tray though the assistant tray has not been added, the image forming apparatus executes an imaging process as it is. Thus, an image defect is caused by a failure in transport such as skew of a long sheet.

SUMMARY OF THE INVENTION

The invention is developed to solve the foregoing technical problems. It is an object of the invention to provide a sheet discharge unit, a sheet supply unit and sheet processing apparatus using these units, in which the reliability in handling and reception/transport property for long sheets are enhanced without requiring an extra reception space.

That is, as shown in FIG. 1A, the invention provides a sheet discharge unit for discharging and receiving long sheets S. The sheet discharge unit includes a sheet supply tray 7*a* loaded with long sheets S and a sheet discharge tray 7*b* for receiving the long sheets S. The sheet supply tray 7*a* can supply the long sheets S. The sheet discharge tray 7*b* is also used as the sheet supply tray 7*a*. In the sheet discharge tray 7*b*, the area facing the sheet loading surface of the sheet supply tray 7*a* is used as a sheet discharge surface.

As shown in FIG. 1A, such a sheet discharge unit 7 is, for example, installed in sheet processing apparatus 10 which can process long sheets. An example of such sheet processing apparatus 10 includes image forming apparatus in which an imaging engine 12 is mounted in a processing apparatus body 11, while an image formed by the imaging engine 12 is transferred and fixed on a long sheet S supplied from the sheet supply tray 7*a*, and the long sheet S is discharged to the sheet discharge tray 7*b*.

In such technical measures, it is necessary that the sheet discharge tray 7*b* also serves as the sheet supply tray 7*a*.

Here, the sheet loading surface of the sheet supply tray 7*a* may be identical to the sheet discharge surface of the sheet discharge tray 7*b* or may be different therefrom. In a preferred dual-purpose embodiment, the sheet loading surface is made not identical to the sheet discharge surface.

The preferred dual-purpose embodiment is based on the following idea. That is, when the sheet loading surface is identical to the sheet discharge surface, it is inevitable to perform supply and discharge of sheets one by one. On the contrary, when the sheet loading surface is made not identical to the sheet discharge surface, continuous supply and continuous discharge of the sheets S can be attained.

In addition, it is essential that the sheet discharge surface of the sheet discharge tray 7*b* is an area facing the sheet loading surface of the sheet supply tray 7*a*.

Here, the phrase "the area facing the sheet loading surface is used as the sheet discharge surface" means that the sheet loading surface and the sheet discharge surface are not provided adjacently to each other. Thus, the space for sheet supply and discharge can be reduced.

Further, as a typical dual-purpose type sheet discharge unit, the sheet supply tray 7*a* includes side guides (not shown) for regulating the width-direction positions of the long sheets S, and the sheet discharge tray 7*b* is constituted by the side guides.

In the embodiment above configured, the side guides are selected to be somewhat large enough to secure a sheet discharge surface.

In addition, in order to regulate the positions of the long sheets S accurately in accordance with their size, it is preferable that the sheet discharge tray 7*b* also used as the sheet supply tray 7*a* includes side guides for regulating the width-direction positions of the long sheets S, and the side guides are provided movably in the sheet feeding direction. Alternatively, it is preferable that the sheet discharge tray 7*b* also used as the sheet supply tray 7*a* includes side guides for regulating the width-direction positions of the long sheets, and the side guides can be disposed detachably in a plurality of positions in the sheet feeding direction.

Further, in a typical embodiment using the dual-purpose type sheet discharge unit 7, there is provided sheet-processing apparatus for performing predetermined processing on supplied long sheets S, and then discharging and receiving the long sheets S in the sheet discharge unit 7. The sheet processing apparatus includes the dual-purpose type sheet discharge unit 7 and a discharge guide unit 8 provided detachably in a part of the transport path of the supplied long sheets S and for guiding and transporting the long sheets S toward the sheet discharge tray 7*b*.

Here, the requirement that the discharge guide unit 8 is detachable in a part of the transport path is to make it possible to detach the discharge guide unit 8 and attain regular sheet discharge processing when regular sheets S other than the long sheets S are discharged.

In addition, in a typical embodiment of the discharge guide unit 8, the discharge guide unit 8 may include a discharge surface adjusting portion for selecting the front/back surface position of a discharged sheet with respect to the sheet discharge tray 7*b*.

The embodiment hence provided allows the discharge guide unit 8 to adjust the posture of the discharged sheets S. Specifically, various systems such as a flapper system provided with a swingable flapper or an extension guide system provided with an extension guide is used as the discharge surface adjusting portion.

Further, in order to keep stability in receiving discharged sheets in the embodiment of the "dual-purpose type sheet supply unit with a discharge guide unit", it is preferable that the sheet discharge unit 7 includes a stopper guide for blocking a discharged sheet travelling toward the sheet supply port of the sheet supply tray 7*a*.

According to the embodiment above configured, the situation that the discharged sheet S is supplied again by accident can be avoided by the stopper guide.

In addition, the invention is not limited to the dual-purpose type sheet discharge unit, but includes another embodiment of a sheet discharge unit.

In the embodiment above configured, the invention provides a sheet discharge unit 7 for discharging and receiving long sheets S as shown in FIG. 1B. That is, a discharge/reception unit 7*c* is provided detachably in a part of the transport path of the long sheets S supplied from a sheet supply unit 5, and the long sheets S are discharged and received in the discharge/reception unit 7*c*.

Further, according to another embodiment, as shown in FIG. 1B, the invention provides a sheet discharge unit 7 for discharging and receiving long sheets S, which unit includes a standard sheet discharge tray 7*d* and a discharge/reception unit 7*e*. The standard sheet discharge tray 7*d* discharges and receives not-long sheets therein. The discharge/reception unit 7*e* is provided detachably adjacently to the standard sheet discharge tray 7*d* and can receive a part of discharged long sheets S.

In addition, the invention is not limited to the sheet discharge unit shown in FIG. 1B, but is also aimed at sheet processing apparatus using the sheet discharge unit.

Further, the invention provides a sheet supply unit 5 for supplying loaded sheets S as shown in FIG. 2A. That is, the sheet supply unit 5 includes a standard sheet tray 5*a*, an extension sheet tray 5*b* and an extension detection unit 5*c*. The standard sheet tray 5*a* can receive standard sheets. The extension sheet tray 5*b* is provided extensibly on the sheet-feeding-direction upstream side of the standard sheet tray 5*a*. The extension sheet tray 5*b* extends a sheet reception surface in cooperation with the standard sheet tray in a long sheet use mode. The extension detection unit 5*c* detects whether the extension sheet tray 5*b* is set for extension with respect to the standard sheet tray 5*a* or not.

For example, such a sheet supply unit 5 is installed in sheet processing apparatus 10 which can process long sheets S as shown in FIG. 2A. An example of such sheet processing apparatus 10 includes image forming apparatus in which an imaging engine 12 is mounted in a processing apparatus body 11, while an image formed by the imaging engine 12 is transferred and fixed on a long sheet S supplied from the sheet supply unit 5, and then the long sheet S is, for example, discharged to a sheet discharge unit 7 through a discharge guide unit 8.

In such technical measures, the sheet supply unit 5 includes a cassette type as well as a manual sheet insertion type.

In addition, the standard sheet tray 5*a* may receive not-long sheets (including a standard-size type and a nonstandard-size type) S. The standard sheet tray 5*a* usually has sheet guides (side and end) for positioning the sheets S received therein.

Further, although the extension sheet tray 5*b* may be provided extensibly, it is preferable that the extension sheet tray 5*b* is extensible/retractable or attachable/detachable (an extensible/retractable system or an attachable/detachable system) with respect to the standard sheet tray 5*a* in consideration of reducing the space when regular sheets S other than the long sheets S are used.

Furthermore, the extension detection unit 5*c* may indeed detect directly that the extension sheet tray 5*b* has been defined for extension, but the extension detection unit 5*c* may detect indirectly a fact accompanied with the fact that the extension sheet tray 5*b* has been set for extension.

In addition, according to a typical embodiment of the extensible/retractable system of the extension sheet tray 5*b*, the extension sheet tray 5*b* includes an extension component provided to be erectable/reclinable on the sheet-feeding-direction upstream side of the standard sheet tray 5*a*.

Particularly, in a embodiment in which the sheet supply unit 5 is a cassette type, in other words, in a embodiment in which the sheet supply unit 5 is installed in the processing apparatus body 11, the extension component of the extension sheet tray 5*b* may be made erectable/reclinable interlocking with an open/close operation of a not-shown open/close cover provided in the processing apparatus body.

Further, in order to make the support of the long sheets S more stable, it is preferable that the extension sheet tray 5*b* includes an erectable/reclinable extension component, and an assistant extension component that can extend further from the extension component.

In addition, the detection manner of the extension detection unit 5*c* may be selected suitably. For example, a mode of using the change of the state of the extension sheet tray 5*b* may be selected, or the mode of using the change of the sheet end guide may be selected.

In the case of the former mode, when the extension sheet tray 5*b* includes an erectable/reclinable extension component, the erecting/reclining state of the erectable/reclinable extension component may be detected.

On the other hand, in the case of the latter mode, the standard sheet tray 5*a* may include a sheet end guide transformable not to be an obstacle to the loading of long sheets S in the long sheet use mode, and the extension detection unit 5*c* may detect the transformed state of the sheet end guide.

Particularly, the following embodiment is typical in the latter mode. That is, the standard sheet tray 5*a* includes an erectable/reclinable sheet end guide that is reclined in the long sheet use mode, and the extension detection unit 5*a* detects the erecting/reclining state of the sheet end guide. Alternatively, the standard sheet tray 5*a* includes a sheet end guide which is movable in a shunting position deviated from a loading position of the long sheets S in the long sheet use mode, and the extension detection unit 5*c* detects whether the sheet end guide is located in the shunting position or not.

In addition, although the sheet supply unit 5 shown in FIG. 2A is illustrated as a so-called cassette type sheet supply unit by way of example, not to say, the invention may be applied to a manual sheet insertion type sheet supply unit as shown in FIG. 2B.

In the embodiment above configured, the manual sheet insertion type sheet supply unit 5 may include a standard sheet tray 5*d*, an extension sheet tray 5*e* and an extension detection unit 5*c*. The extension sheet tray 5*e* is provided extensibly on the sheet-feeding-direction upstream side end portion of the standard sheet tray 5*d*. The extension detection unit 5*c* is provided for detecting the presence/absence of the extension of the extension sheet tray 5*e*.

In addition, the invention is not limited to the sheet supply unit, but is also aimed at sheet processing apparatus having the sheet supply unit installed therein.

In the above configured embodiment, according to the invention, as shown in FIG. 2A, the sheet supply unit 5 and a sheet discharge unit 7 may be provided. The sheet discharge unit 7 discharges and receives long sheets S supplied from the sheet supply unit 5.

According to one embodiment, the sheet processing apparatus includes the sheet discharge unit 7 (including the sheet supply tray 7*a* and the sheet discharge tray 7*b*) shown in FIG. 1A, and a discharge guide unit 8. The discharge guide unit 8 is provided detachably in a part of the transport path of the supplied long sheets S and for guiding and transporting the long sheets S toward the sheet discharge unit 7.

In addition, according to another embodiment, as shown in FIG. 2B, the sheet discharge unit 7 includes a discharge/reception unit 7*c* detachably provided in a part of the transport path of the long sheets S supplied from the sheet supply unit 5, and the long sheets S are discharged and received in the discharge/reception unit 7*c*.

Further, according to a further embodiment, as shown in FIG. 2B, the sheet discharge unit 7 includes a standard sheet discharge tray 7*d* and a discharge/reception unit 7*e*. Not-long sheets are discharged and received in the standard sheet discharge tray 7*d*. The discharge/reception unit 7*e* is provided detachably adjacently to the standard sheet discharge tray 7*d* and can receive a part of discharged long sheets S.

In addition, in order to execute the long sheet use mode stably, as shown in FIGS. 2A and 2B, a control unit 15 may be provided. The control unit 15 makes the long sheet use mode executable after detecting that at least the sheet supply unit 5 and the sheet discharge unit 7 have been set in a state corresponding to the long sheet use mode.

According to the above configured embodiment, when the sheet supply unit 5 and the sheet discharge unit 7 have not been set in the long sheet use mode, the long sheet use mode is made not executable. Thus, there is no fear that the long sheets S are processed in the state where the long sheets S cannot be set in the sheet supply unit 5 or in the state where the sheet discharge unit 7 is not set to receive the long sheets S. Thus, the reliability in handling the long sheets S is enhanced correspondingly.

Particularly, in a embodiment in which the discharge guide unit 7 is installed as shown in FIG. 2A, there may be provided a control unit for making the long sheet use mode executable after detecting that at least the sheet supply unit and the discharge guide unit have been set in a state corresponding to the long sheet use mode.

According to the above configured embodiment, when the sheet supply unit 5 and the discharge guide unit 8 have not been set in the long sheet use mode, the long sheet use mode is made not executable. Thus, there is no fear that the long sheets S are processed in the state where the long sheets S cannot be set in the sheet supply unit 5 or in the state where the discharge guide unit 8 has not been set in the processing apparatus body. Thus, the reliability in handling the long sheets S is enhanced correspondingly.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

The invention will be described below in detail based on its embodiments shown in the accompanying drawings.

First Embodiment

Figure 1A:
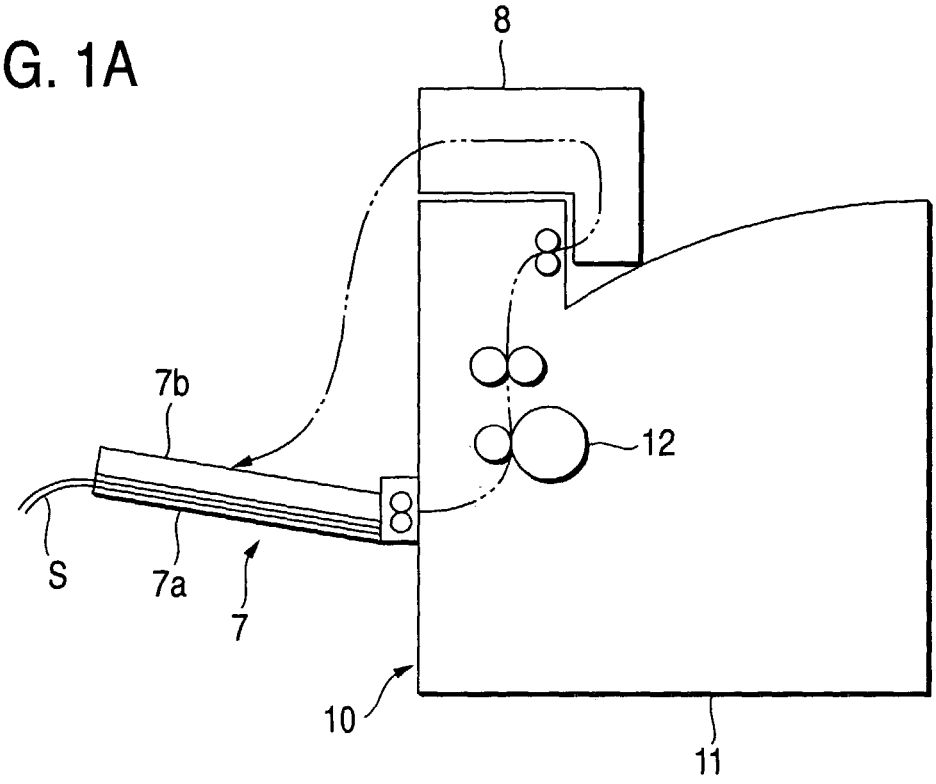
FIG. 1A is an explanatory view schematically showing a sheet discharge unit and sheet processing apparatus using the sheet discharge unit according to the invention.
Figure 1B:
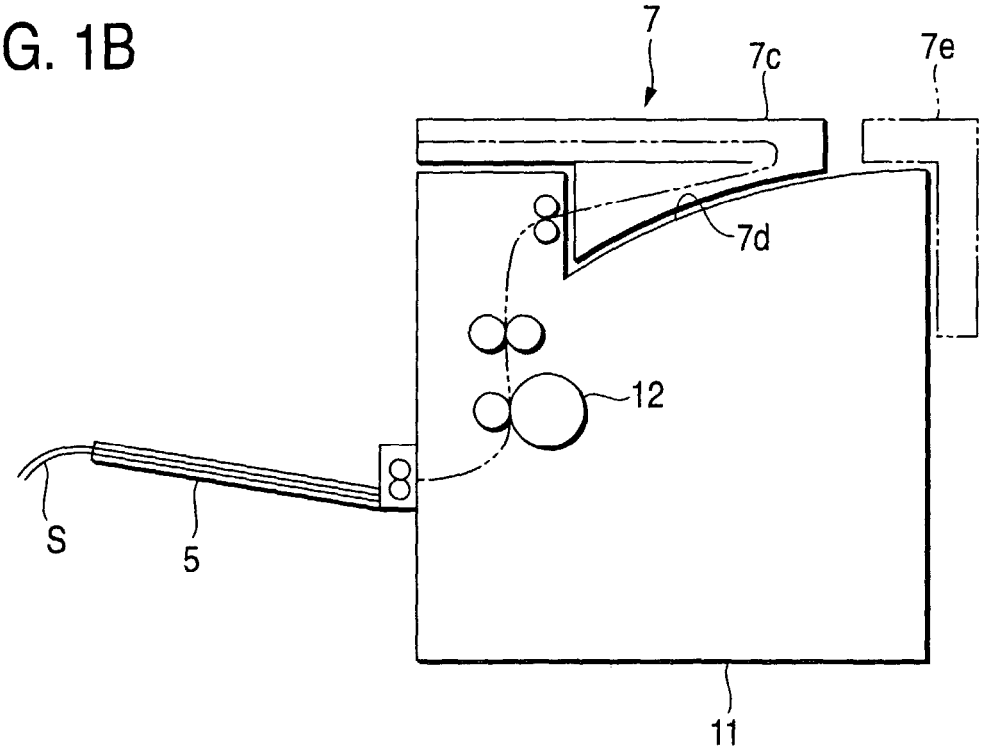
FIG. 1B is an explanatory view showing a sheet discharge unit and sheet processing apparatus using the sheet discharge unit according to another embodiment of the invention.
Figure 2A:
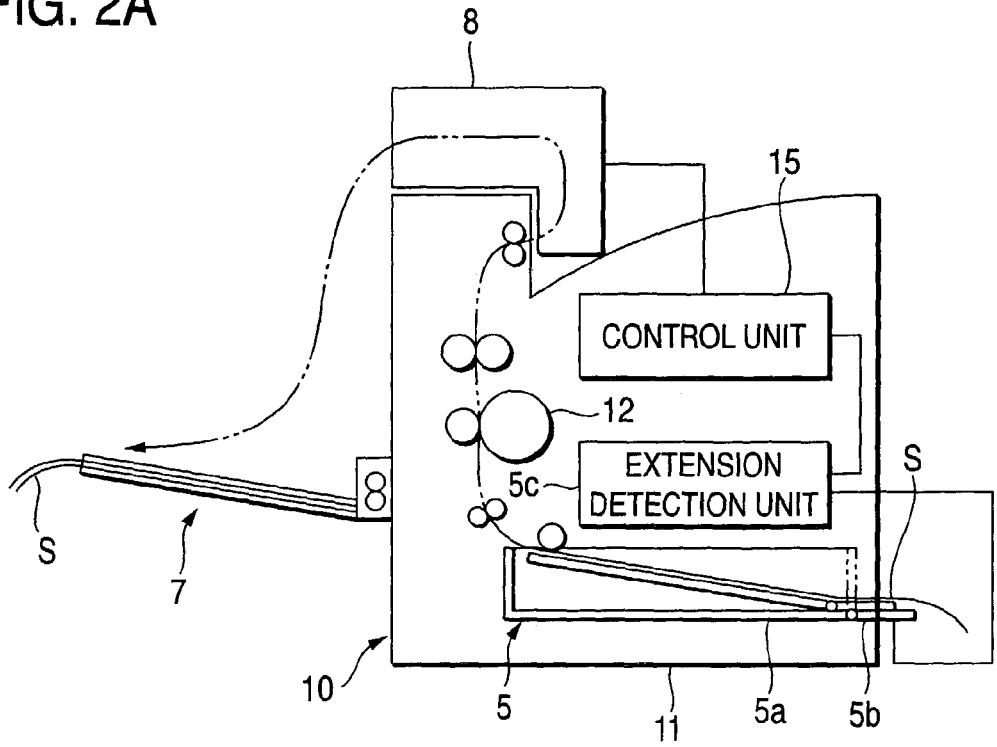
FIG. 2A is an explanatory view schematically showing a sheet supply unit and sheet processing apparatus using the sheet discharge unit according to the invention.
Figure 2B:
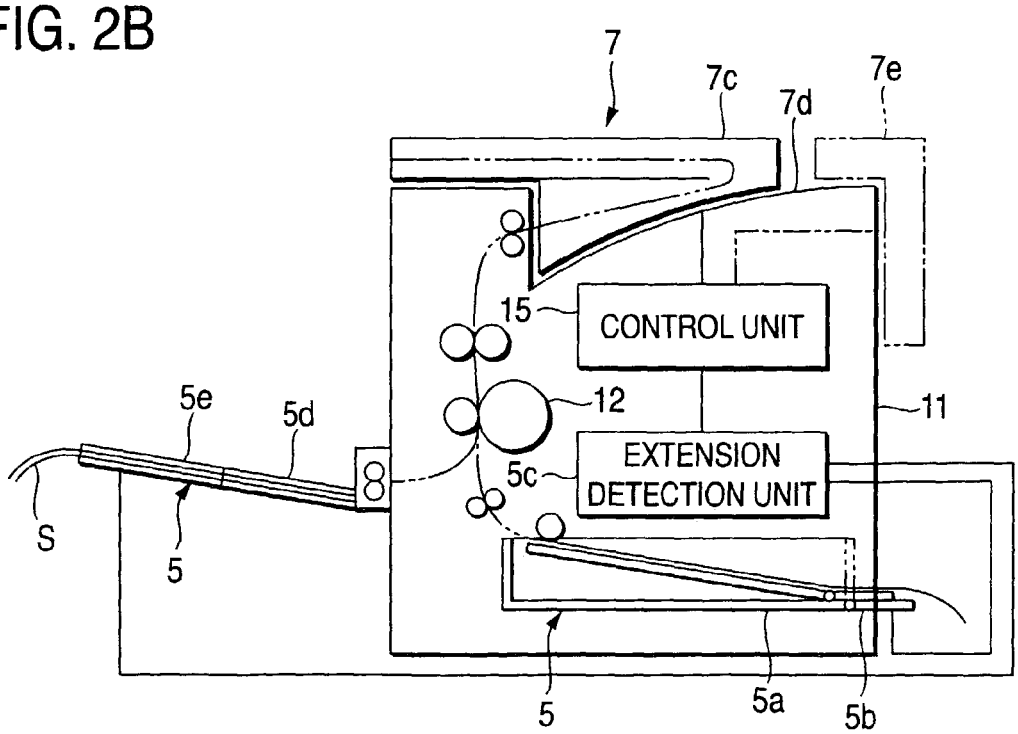
FIG. 2B is an explanatory view showing a sheet supply unit and sheet processing apparatus using the sheet discharge unit according to another embodiment of the invention.
Figure 3:
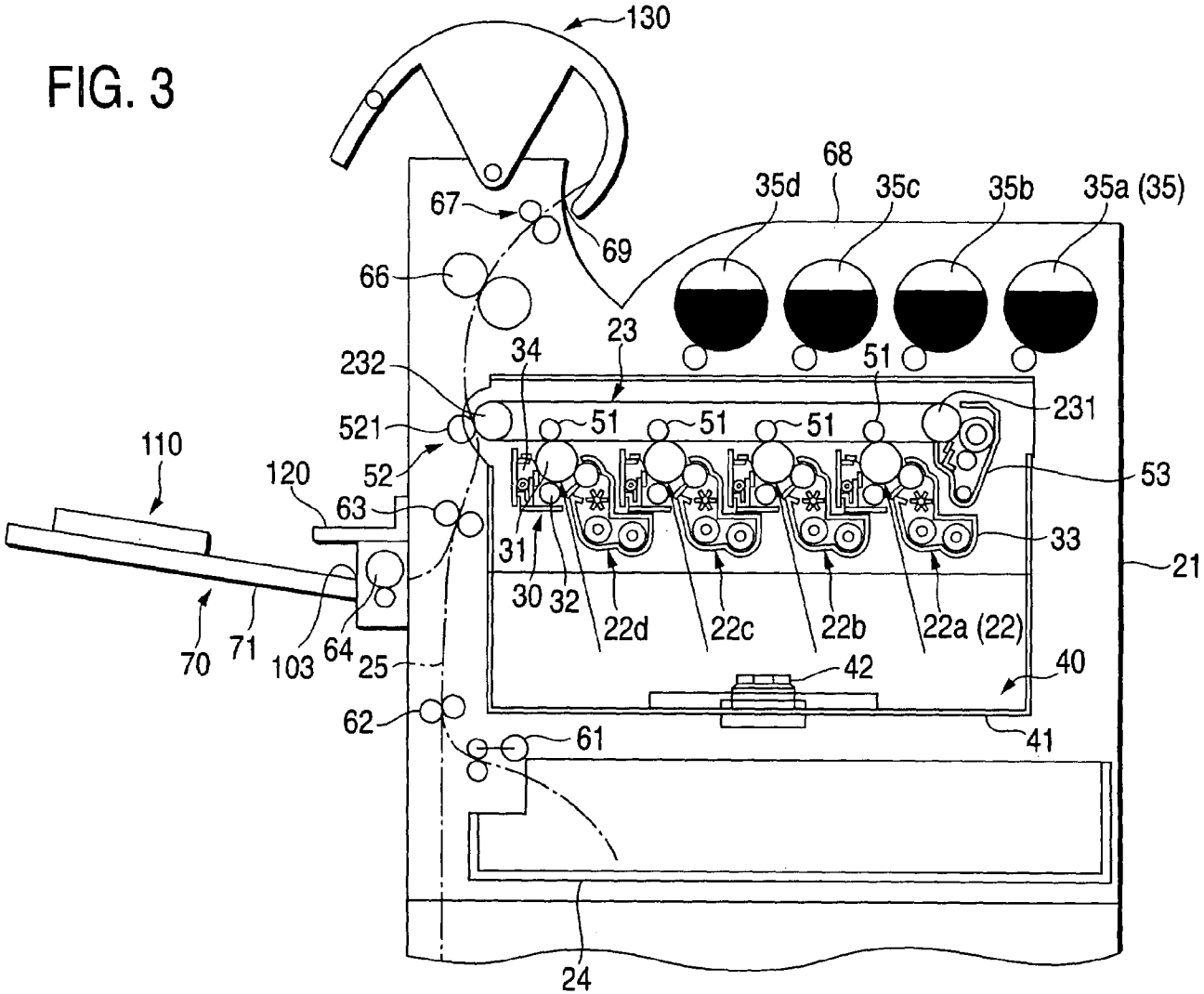
FIG. 3 is an explanatory view showing the whole configuration of image forming apparatus as sheet processing apparatus according to a first embodiment.

FIG. 3 is an explanatory view showing a first embodiment of tandem type image forming apparatus as sheet processing apparatus to which the invention is applied.

In FIG. 3, the tandem type image forming apparatus has imaging units 22 (specifically 22*a* to 22*d*) for four colors (black, yellow, magenta and cyan in the first embodiment) arrayed laterally in a body housing 21. Above the imaging units 22, an intermediate transfer belt 22 is disposed to be conveyed and circulated in the array direction of the image units 22. In addition, a sheet supply cassette 24 for receiving sheets (not shown) such as paper is disposed in the lower portion of the body housing 21, while a sheet transport path 25 from the sheet supply cassette 24 is disposed substantially vertically.

In the first embodiment, the imaging units 22 (22*a* to 22*d*) are to form toner images for black, yellow, magenta and cyan (not always arranged in that order) respectively in the downstream order in the circulating direction of the intermediate transfer belt 23 by way of example. The imaging units 22 have individual photoconductor units 30, individual developing units 33 and a common exposure unit 40.

Here, for example, each photoconductor unit 30 is made into a cartridge integrally constituted by a photoconductor drum 31, a charger (charging roll in the first embodiment) 32 for charging the photoconductor drum 31 in advance, and a cleaner 34 for removing residual toner on the charged photoconductor drum 31, so as to form a so-called CRU (Customer Replaceable Unit).

In addition, by each developing unit 33, an electrostatic latent image formed on the charged photoconductor image 31 by the exposure of the exposure unit 40 is developed with a corresponding color toner (for example, negative in polarity in the first embodiment).

Incidentally, the reference numeral 35 (35*a* to 35*d*) represents a toner cartridge for supplying color component toner to each developing unit 33 (its toner supply path is not shown).

On the other hand, the exposure unit 40, for example, has four semiconductor lasers (not shown), one polygon mirror 42, an imaging lens (not shown), and mirrors (not shown) corresponding to the photoconductor units 30 respectively, so as to be all received in a unit case 41. Light from each semiconductor laser corresponding to each color component is deflected and scanned by the polygon mirror 42 so that an image of the light is guided into an exposure point on the corresponding photoconductor drum 31 through the imaging lens and the mirror.

In addition, in the first embodiment, the intermediate transfer belt 23 is, for example, laid between a pair of stretch rolls (one of which is a drive roll) 231 and 232. Primary transferors (primary transfer rolls in the first embodiment) 51 are disposed on the back surface of the intermediate transfer belt 23 correspondingly to the photoconductor drums 31 of the photoconductor units 30 respectively. When a voltage whose polarity is reverse to the charging polarity of toner is applied to each primary transferor 51, the toner image on the corresponding photoconductor drum 31 is electrostatically transferred to the intermediate transfer belt 23.

Further, a secondary transferor 52 is disposed in a portion corresponding to the stretch roll 232 of the intermediate transfer belt 23 on the downstream of the most downstream imaging unit 22*d*. By the secondary transferor 52, the primary transferred images on the intermediate transfer belt 23 are secondary-transferred (batch-transferred) onto a recording material.

In the first embodiment, the secondary transferor 52 is provided with a secondary transfer roll 521 disposed to pressure-contact with the toner image holding surface side of the intermediate transfer belt 23, and a backup roll (also used as the stretch roll 232 in the first embodiment) disposed on the back surface side of the intermediate transfer belt 23 so as to form an electrode opposed to the secondary transfer roll 521.

Then, for example, the secondary transfer roll 521 is grounded while a bias whose polarity is identical to the charging polarity of the toner is applied to the backup roll (stretch roll 232).

Furthermore, a belt cleaner 53 is disposed on the upstream side of the most upstream imaging unit 22*a* of the intermediate transfer belt 23 so as to remove residual toner on the intermediate transfer belt 23.

In addition, the sheet supply cassette 24 is provided with a feeder (for example, arranged as a unit for picking up sheets through a nudger roll, then managing and delivering the sheets one by one through a feed roll and a retard roll) 61 for picking up and delivering the sheets. Take-away rolls 62 for delivering the sheets are disposed immediately after the feeder 61, and registration rolls 63 for supplying a recording material to a secondary transfer portion at predetermined timing are disposed in the sheet transport path 25 located immediately before the secondary transfer portion.

On the other hand, a fixing unit 66 is provided in the sheet transport path 25 located on the downstream side of the secondary transfer portion. Sheet discharge rolls 67 are provided on the downstream side of the fixing unit 66. A discharge tray 68 is formed in the top portion of the body housing 21 so as to receive discharged standard-size sheets.

Further, in the first embodiment, a manual sheet insertion type sheet supply unit (MSI) 70 is provided on a side of the body housing 21 so that a sheet on the manual sheet insertion type sheet supply unit 70 is delivered toward the sheet transport path 25 through a feeder 64 and the registration rolls 63.

In the first embodiment, the manual sheet insertion type sheet supply unit 70 has a sheet tray (sheet supply tray) 100 and side guides 101. Long sheets S can be loaded on the sheet tray 100. The side guides 101 are provided on the sheet tray S so as to regulate the width-direction positions of the loaded sheets S.

Figure 4A:
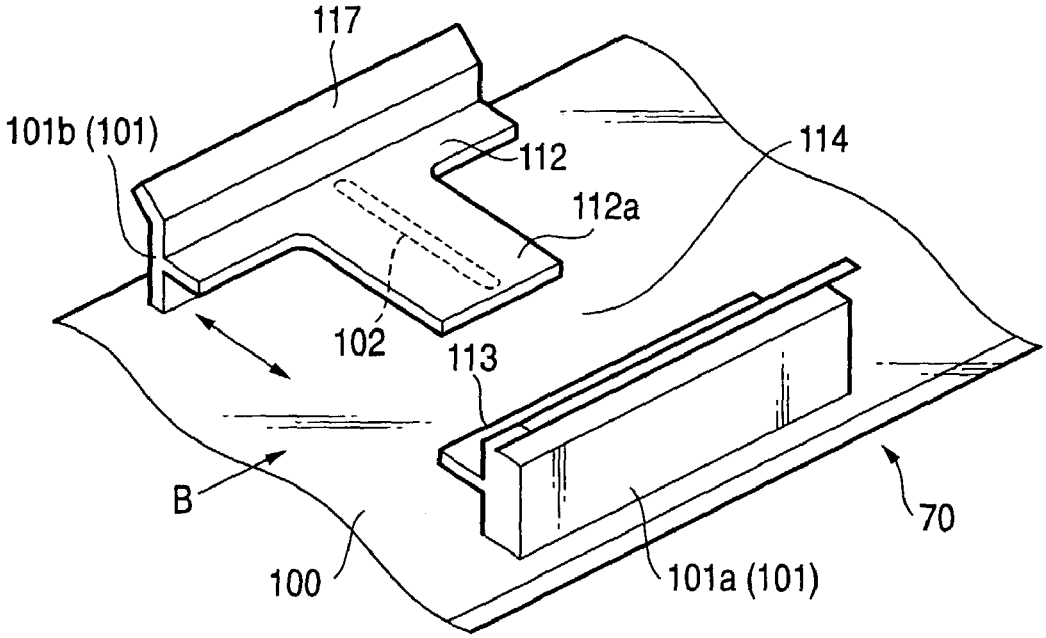
FIG. 4A is an explanatory view showing a main portion of a sheet discharge unit according to the first embodiment.
Figure 4B:
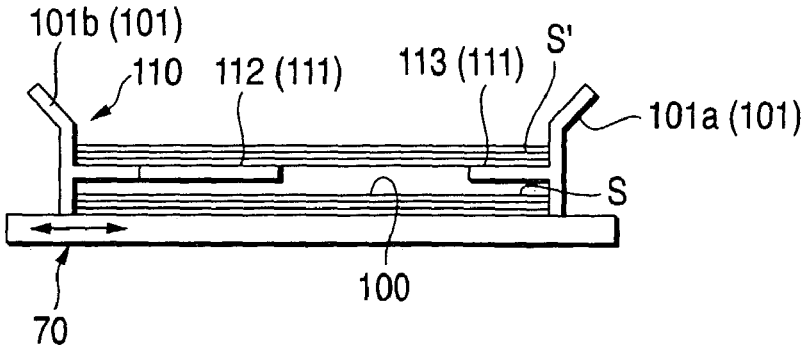
FIG. 4B is a sectional view taken in direction B in FIG. 4A.

Then, the side guides 101 includes a fixed side guide 101*a* and a movable side guide 101*b* as shown in FIGS. 4A and 4B. The movable side guide 101*b* can move in the width direction of the sheets.

Here, for example, the movable side guide 101*b* has a not-shown guide shoe slidably engaged with a guide slit 102 formed in the width direction of the sheet tray 100, so as to regulate the positions of the opposite sides of the sheets.

Incidentally, the structure of the sheet tray 100, the support structure of the fixed side guide 101*a* and the support structure of the movable side guide 101*b* may be designed suitably. Not to say, examples of those structures include various forms (such as an extensible sheet tray, a detachable sheet tray, sheet-feeding-direction movable type side guides, sheet-feeding-direction multi-allocatable type side guides), which will be described in a second embodiment.

Particularly, in the first embodiment, the manual sheet insertion type sheet supply unit 70 is also used as a special sheet discharge unit 110 supporting the long sheets S.

In the above configured special sheet discharge unit 110, a sheet discharge tray 111 is formed out of the side guides 101 as shown in FIG. 3 and FIGS. 4A and 4B. The sheet discharge tray 111 has sheet support pieces 112 and 113 projecting from the inner surfaces of the side guides 101 (101*a* and 101*b*) respectively. An extension support portion 112*a* extending to the vicinity of substantially the center of the sheet discharge tray 111 is formed in at least one 112 of the sheet support pieces so as to support discharged sheets S' stably. Thus, a sheet discharge surface is formed out of the sheet support pieces 112 and 113. Incidentally, the side guides 101 regulate the width-direction positions of the discharged sheets S' also in the special sheet discharge unit 110.

In above configured form, the sheet discharge tray 111 is formed out of a pair of sheet support pieces 112 and 113 while a space 114 is secured between the sheet support pieces 112 and 113. Thus, there is no fear that the workability in setting the sheets S to be supplied to the sheet tray (sheet supply tray) 100 is spoiled.

Figure 5:
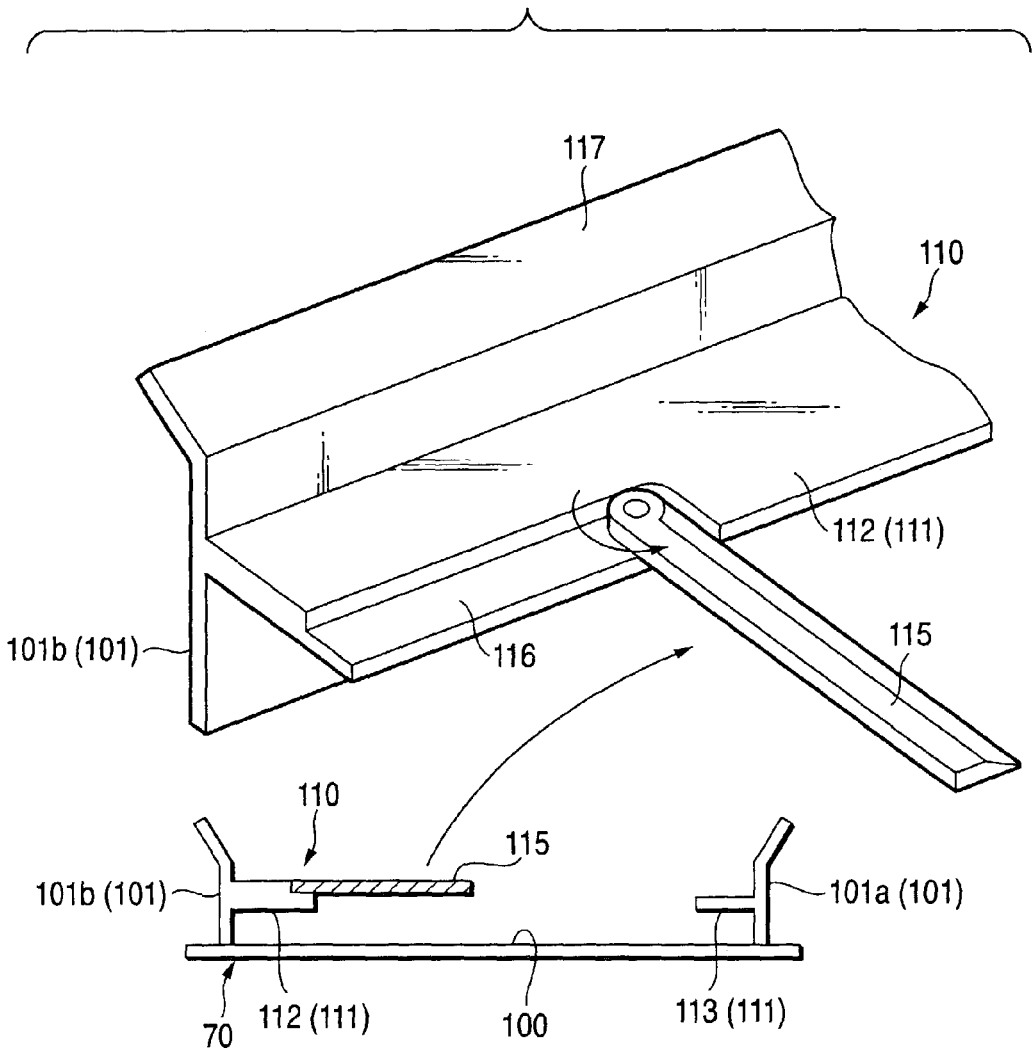
FIG. 5 is an explanatory view showing a main portion of a modification of the sheet discharge unit according to the first embodiment.

Particularly, in order to keep in better condition the workability in setting the sheets S to be supplied to the sheet tray 100, for example, as shown in FIG. 5, it is preferable that a rotatable lateral support bar 115 is provided additionally in the substantially central portion of the projecting end of the sheet support piece 112 which is one of the sheet support pieces constituting the sheet discharge tray 111. Thus, the sheet support area of the discharged sheets S' is secured by the lateral support bar 115.

According to above configured form, for example, at the time of work for setting the sheets S to be supplied, the lateral support bar 115 can be shunted and received temporarily in a shunting area 116 facing the sheet support piece 112. In this state, the lateral support bar 115 is absent temporarily between the sheet support pieces 112 and 113 so that the space 114 between the sheet support pieces 112 and 113 can be secured to be wide enough to secure a sufficient space for the work for setting the sheets S to be supplied to the sheet tray 100.

Further, in the first embodiment, a guide taper portion 117 opened obliquely upward is formed in the upper end portion of each side guide 101. The guide taper portions 117 serve to guide the discharged sheets S' discharged from above into the sheet discharge tray 111.

Furthermore, in the first embodiment, in the special sheet discharge unit 110, a regulation guide 120 for regulating the rear end position of the discharged sheets is disposed above a sheet supply port 103 of the sheet tray (sheet supply tray) 100 as shown in FIG. 3.

The regulation guide 120 is, for example, formed out of a sectionally L-shaped member. In the first embodiment, the regulation guide 120 is disposed to project to close the upper portion of the sheet supply port 103 of the sheet tray 100. Thus, the regulation guide 120 prevents the rear end portions of the discharged sheets from entering the sheet supply port 103 of the sheet tray 100, and supports the rear end portions of the discharged sheets.

In addition, in the first embodiment, a discharge guide unit 130 is detachably disposed in the top portion of the body housing 21, specifically in a portion located adjacently to the discharge tray 68 and on the side of the special sheet discharge unit 110 as shown in FIG. 3.

Figure 6A:
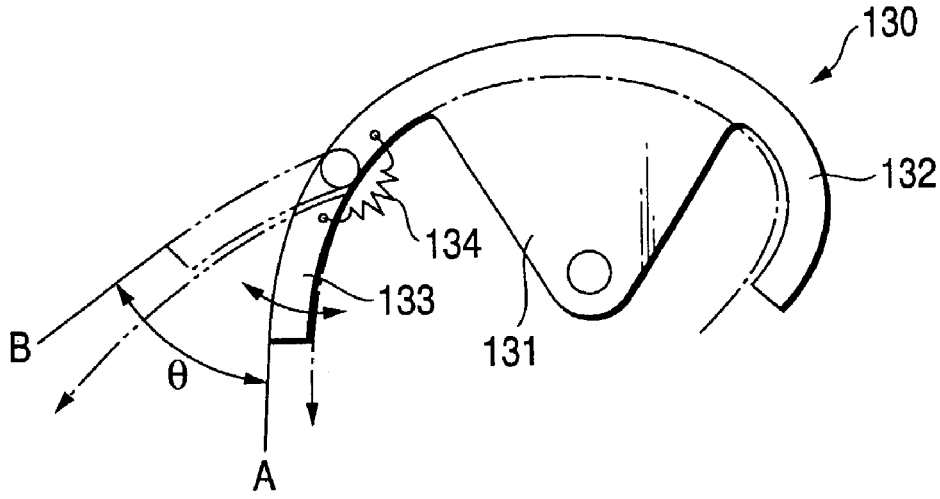
FIG. 6A is an explanatory view showing a discharge guide unit for use in the first embodiment.

For example, the discharge guide unit 130 has a unit body 131 detachably attached to the body housing 21 as shown in FIG. 6A. In the unit body 131, a semiloop-like curved guide portion 132 is formed so that a sheet discharged from the sheet discharge port 69 of the body housing 21 is transported counterclockwise substantially by half turn.

Also, a swingable flap 133 is provided at the sheet discharge end of the curved guide portion 132 so as to set the discharge posture of a discharged sheet to be variable suitably.

The flap 133 has a first reference position A extending substantially in the tangential direction of the guide surface of the curved guide portion 132 and a second reference position B shifted outside from the first reference position A by a predetermined angle θ. The position of the flap 133 is regulated in each reference position by a not-shown stopper.

The flap 133 is provided with an urging spring 134 so as to reverse its urging force in accordance with the position of the flap 133. Specifically, when the flap 133 is located in the first reference position A, the urging spring 134 urges the flap 133 so as to hold the flap 133 in the first reference position A. On the other hand, when the flap 133 is moved to the second reference position B manually, the urging spring 134 reverses the action direction of its urging force on the way. Thus, the urging spring 134 urges the flap 133 so as to hold the flap 133 in the second reference position B.

In the first embodiment, the reference positions A and B of the flap 133 are established correspondingly to a face-down discharge mode (a mode in which a sheet is discharged with its image forming surface down) and a face-up discharge mode (a mode in which a sheet is discharged with its image forming surface up) respectively.

Figure 6B:
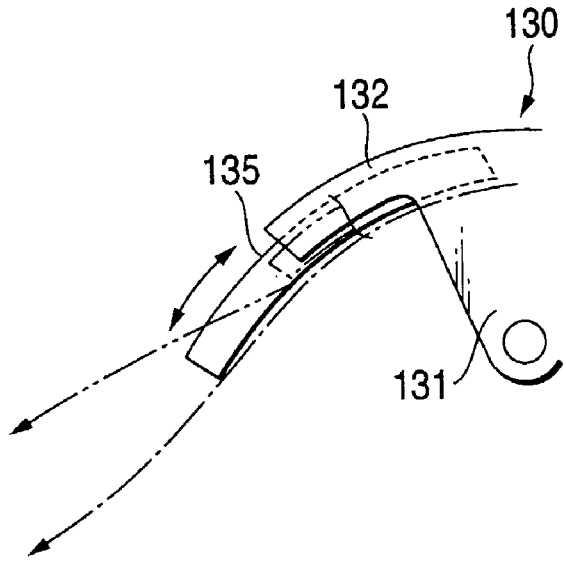
FIG. 6B is an explanatory view showing a modification of the discharge guide unit in FIG. 6A.

Incidentally, although the flap 133 is designed as a two-stage switching type in the first embodiment, the invention is not limited to the above configuration, but the flap 133 may be designed as a multistage switching type. In addition, the manner for making the discharge posture of the discharged sheet variable is not limited to the flap system, but a suitable manner may be selected. For example, an extension guide system as shown in FIG. 6B may be adopted.

Here, the extension guide system will be described. As shown in FIG. 6B, an extensible extension guide 135 is provided at the discharge end of the curved guide portion 132 of the discharge guide unit 130. By changing the front end position of the extension guide 135, the release point of a discharged sheet from the discharge guide is unit 130 is changed so that the discharged posture of the discharged sheet is changed.

Next, description will be made on the operation of the image forming apparatus according to the first embodiment.

Figure 7:
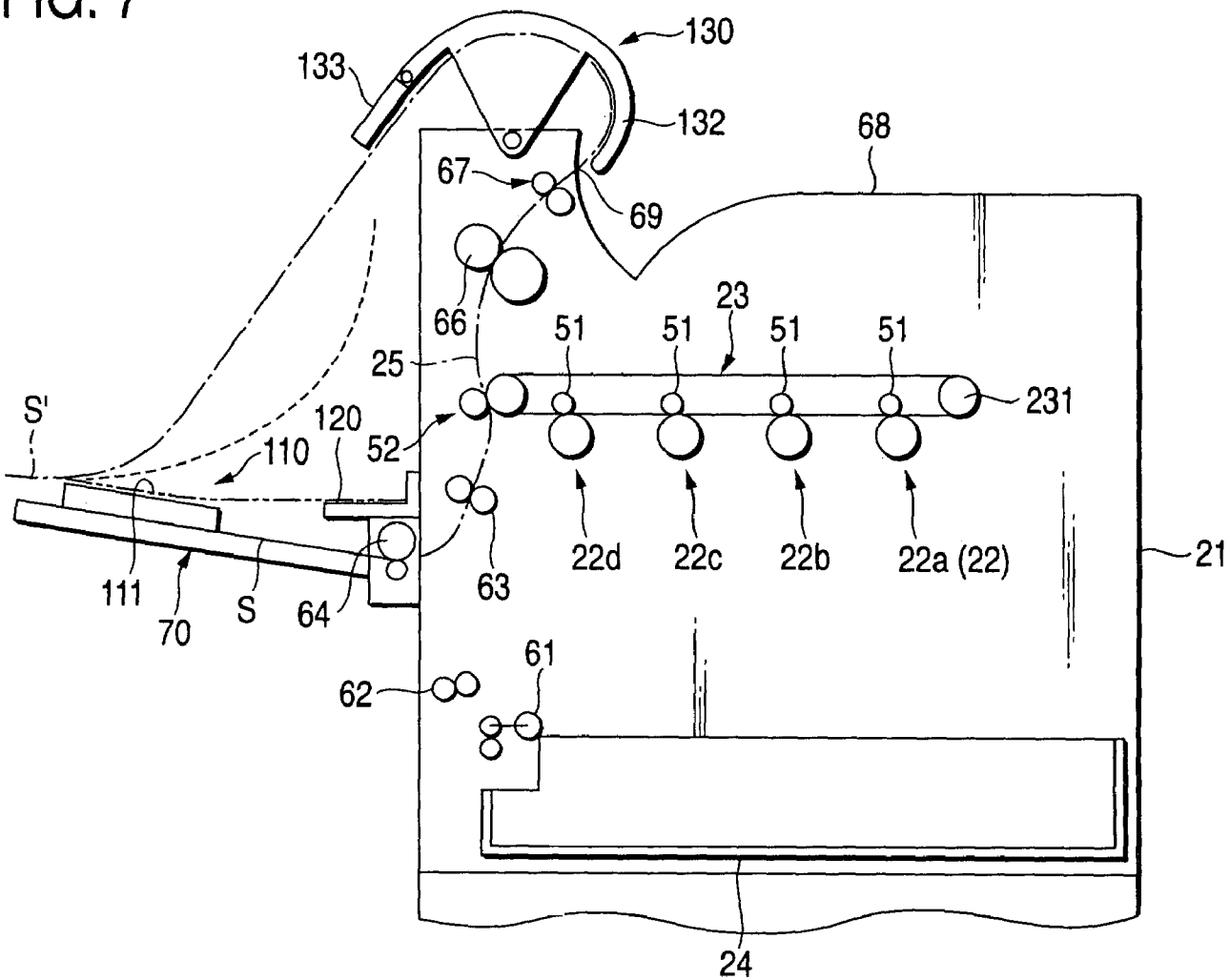
FIG. 7 is an explanatory view showing a face-up discharge mode in the image forming apparatus according to the first embodiment.
Figure 8:
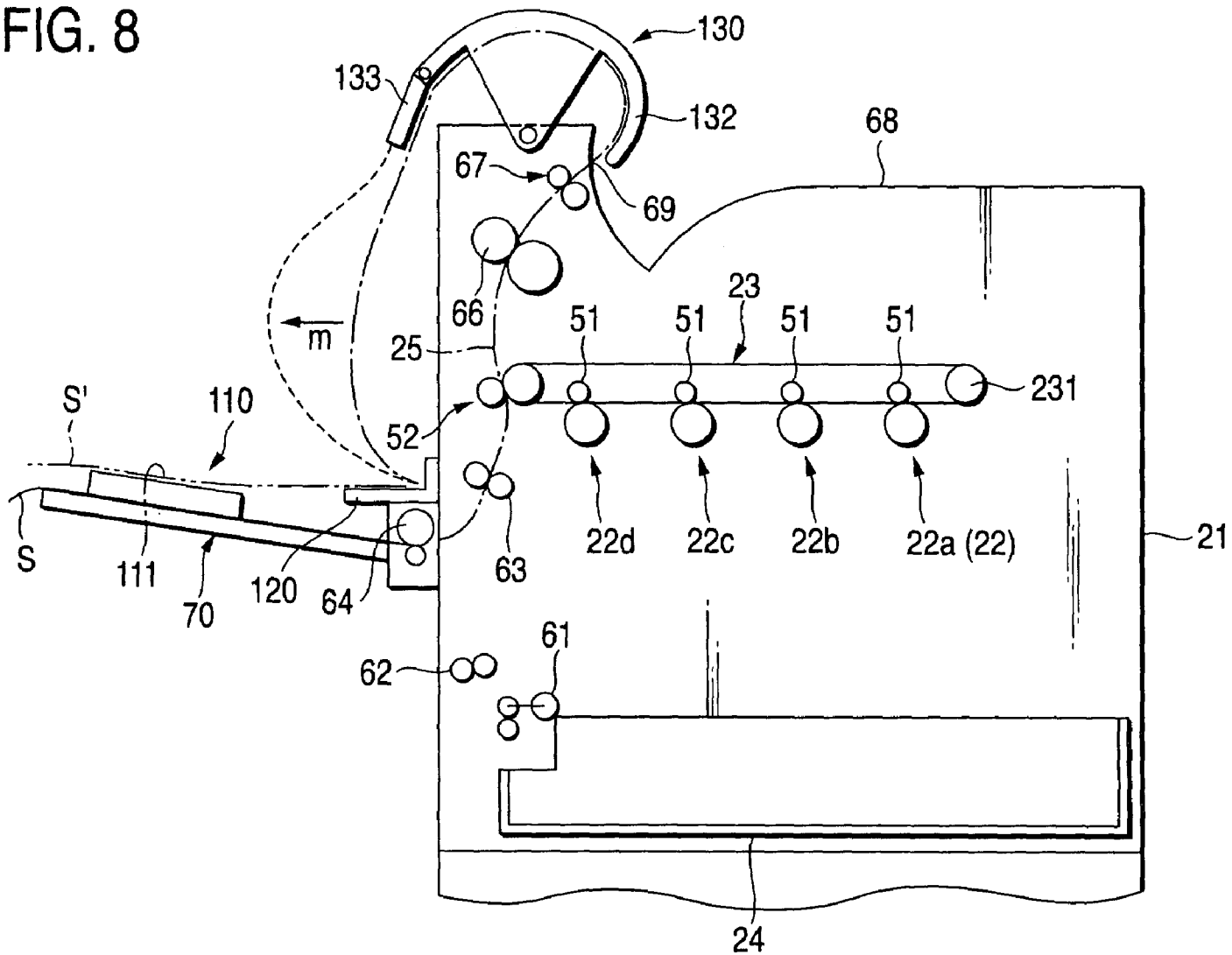
FIG. 8 is an explanatory view showing a face-down discharge mode in the image forming apparatus according to the first embodiment.

When long sheets S are used in the embodiment, as shown in FIGS. 7 and 8, the discharge guide unit 130 is detachably attached to a predetermined portion of the body housing 21, and the long sheets S are set in the manual sheet insertion type sheet supply unit 70.

When the start switch of the image forming apparatus is turned on in this state, the imaging units 22 (22*a*-22*d*) form toner images of their corresponding color components and primary-transfer the toner images onto the intermediate transfer belt 23 sequentially.

On the other hand, a long sheet S supplied from the manual sheet insertion type sheet supply unit 70 reaches a secondary transfer portion through the registration rolls 63 in the sheet transport path 25, and is subjected to secondary transfer in the secondary transfer portion. Thus, the images primary-transferred on the intermediate transfer belt 23 are secondary-transferred onto the long sheet S. After that, the long sheet S is passed through the fixing unit 66 and the sheet discharge rolls 67, and discharged from the sheet discharge port 69 of the body housing 21.

After that, the long sheet S discharged from the sheet discharge port 69 is transported by half-turn along the curved guide portion 132 of the discharge guide unit 130, and then discharged face-up or face-down in accordance with the position of the flap 133. Thus, the long sheet S is discharged and received onto the special sheet discharge unit 110 as shown by the reference sign S' in FIGS. 7 and 8.

Here, description will be made on the operation in each discharge mode of the discharge guide unit 130.

First, in the face-up discharge mode, as shown in FIG. 6A, the flap 133 of the discharge guide unit 130 is set in the second reference position B in advance.

Then, as shown in FIG. 7, the sheet S discharged from the discharge guide unit 130 jumps out in a direction along the inclined posture of the flap 133 with the image forming surface of the sheet S up as shown by the chain line. Further, the sheet S falls by gravity as shown by the broken line. After that, as shown by the chain double-dashed line S', the sheet S is finally loaded on the sheet discharge tray 111 and the regulation guide 120 which are constituent components of the special sheet discharge unit 110.

On the other hand, in the face-down discharge mode, as shown in FIG. 6A, the flap 133 of the discharge guide unit 130 is set in the first reference position A in advance.

Then, the sheet S discharged from the discharge guide unit 130 jumps out in a direction along the inclined posture of the flap 133 with the image forming surface of the sheet S down as shown by the chain line in FIG. 8.

At this time, the front end of the discharged sheet S travels toward the regulation guide 120 so that the discharged sheet S is blocked by the regulation guide 120. Thus, the discharged sheet S does not enter the sheet supply port 103 (see FIG. 3) of the sheet supply tray 100.

Then, as shown by the broken line in FIG. 7, the rear end of the discharged sheet S falls downward by gravity as soon as it escapes from the discharge guide unit 130. Finally, as shown by the chain double-dashed line S' in FIG. 7, the discharged sheet S is loaded on the sheet discharge tray 111 and the regulation guide 120 which are constituent components of the special sheet discharge unit 110.

In such a course of the discharge operation, the flap 133 of the discharge guide unit 130 varies its posture in accordance with the rigidity of the discharged sheet S. Thus, the discharge loop track of the discharged sheet S varies in a direction shown by the arrow m in accordance with the rigidity of the discharged sheet S, that is, specifically, correspondingly to the displacement of the position of the flap 133 from the first reference position A due to the increase of the rigidity of the discharged sheet S.

In addition, in the first embodiment, the special sheet discharge unit 110 is provided to be also used as the manual sheet insertion type sheet supply unit 70. It is therefore unnecessary to provide a special space for installing the special sheet discharge unit 110. In addition, in the first embodiment, the sheet supply tray 100 and the sheet discharge tray 111 are arranged to be not identical to each other. Thus, a plurality of sheets to be supplied and a plurality of sheets to be discharged can be handled continuously.

Second Embodiment

Figure 9:
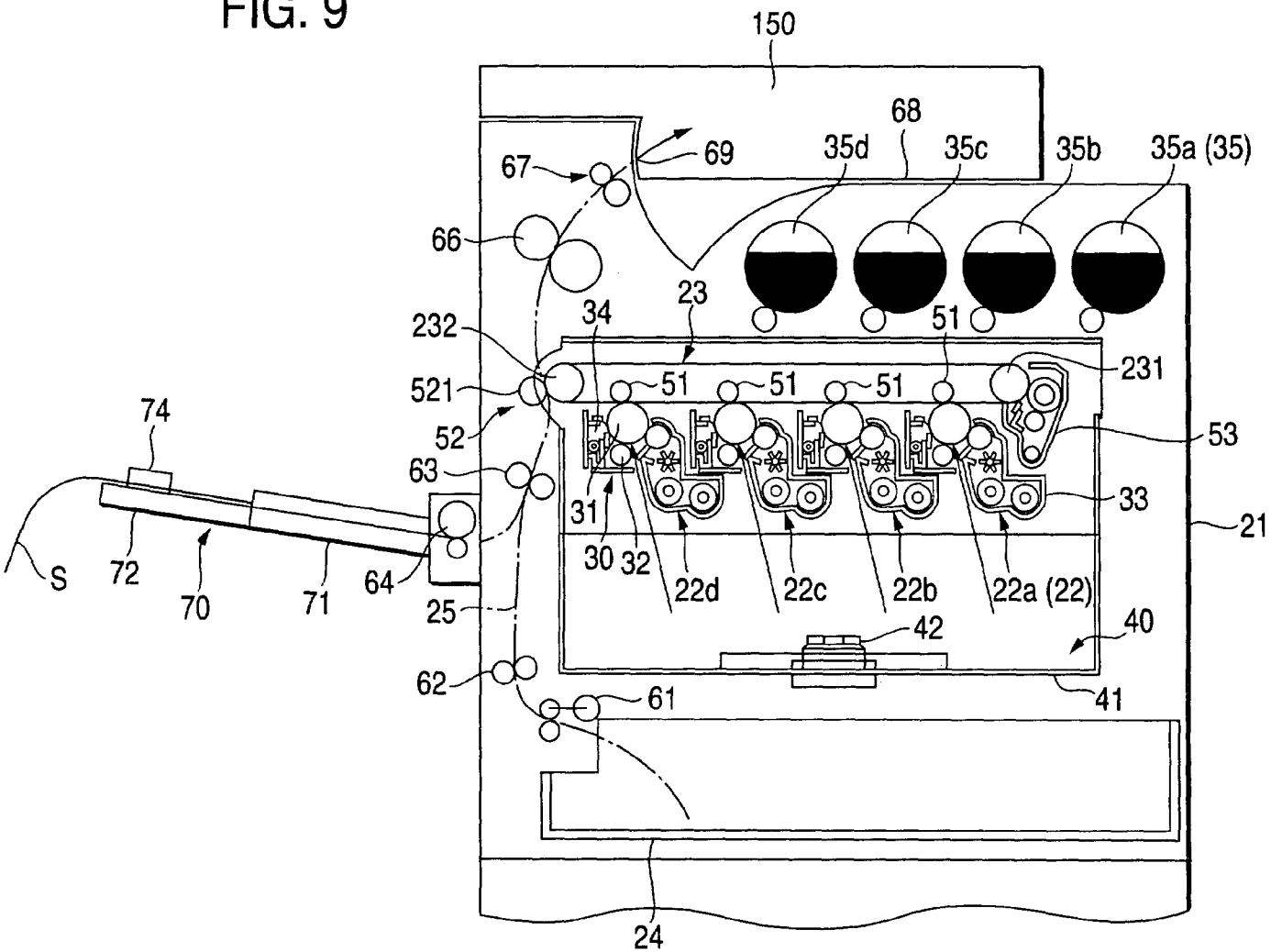
FIG. 9 is an explanatory view showing the whole configuration of image forming apparatus as sheet processing apparatus according to a second embodiment.

FIG. 9 is an explanatory view showing a second embodiment of tandem type image forming apparatus as sheet processing apparatus to which the invention is applied.

The fundamental configuration of the tandem type image forming apparatus in FIG. 9 is substantially the same as that of the first embodiment, except that the manual sheet insertion type sheet supply unit 70 is not used as the special sheet discharge unit, but a discharge/reception unit 150 supporting long sheets is detachably disposed in the top portion of the body housing 21.

Incidentally, constituent components similar to those in the first embodiment are denoted by the same reference numerals as those in the first embodiment correspondingly, and detailed description thereof will be omitted here.

Figure 10:
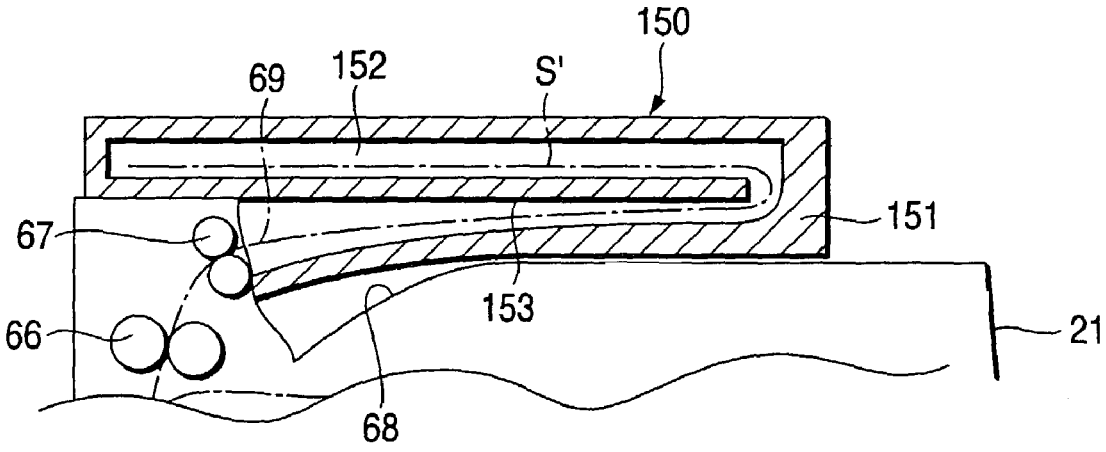
FIG. 10 is an explanatory view showing the operation of a discharge/reception unit for use in the second embodiment.

In the above configured embodiment, the discharge/reception unit 150 has a unit body 151 which is detachably mounted on the discharge tray 68 formed in the top portion of the body housing 21 as shown in FIGS. 9 and 10. In the unit body 151, a spatial portion is formed to be open to the sheet discharge port 69 of the body housing 21. The spatial portion is sectioned by a section plate 153 so as to form a sheet reception chamber 152 for receiving long sheets S in the state where the long sheets S are folded. Incidentally, the bent portion of the sheet reception chamber 152 is designed to make it possible to guide the long sheets S into the inside. For example, a curved guide surface is formed in the wall surface of the sheet reception chamber 152 or guide members such as rollers are disposed therein.

Figure 11:
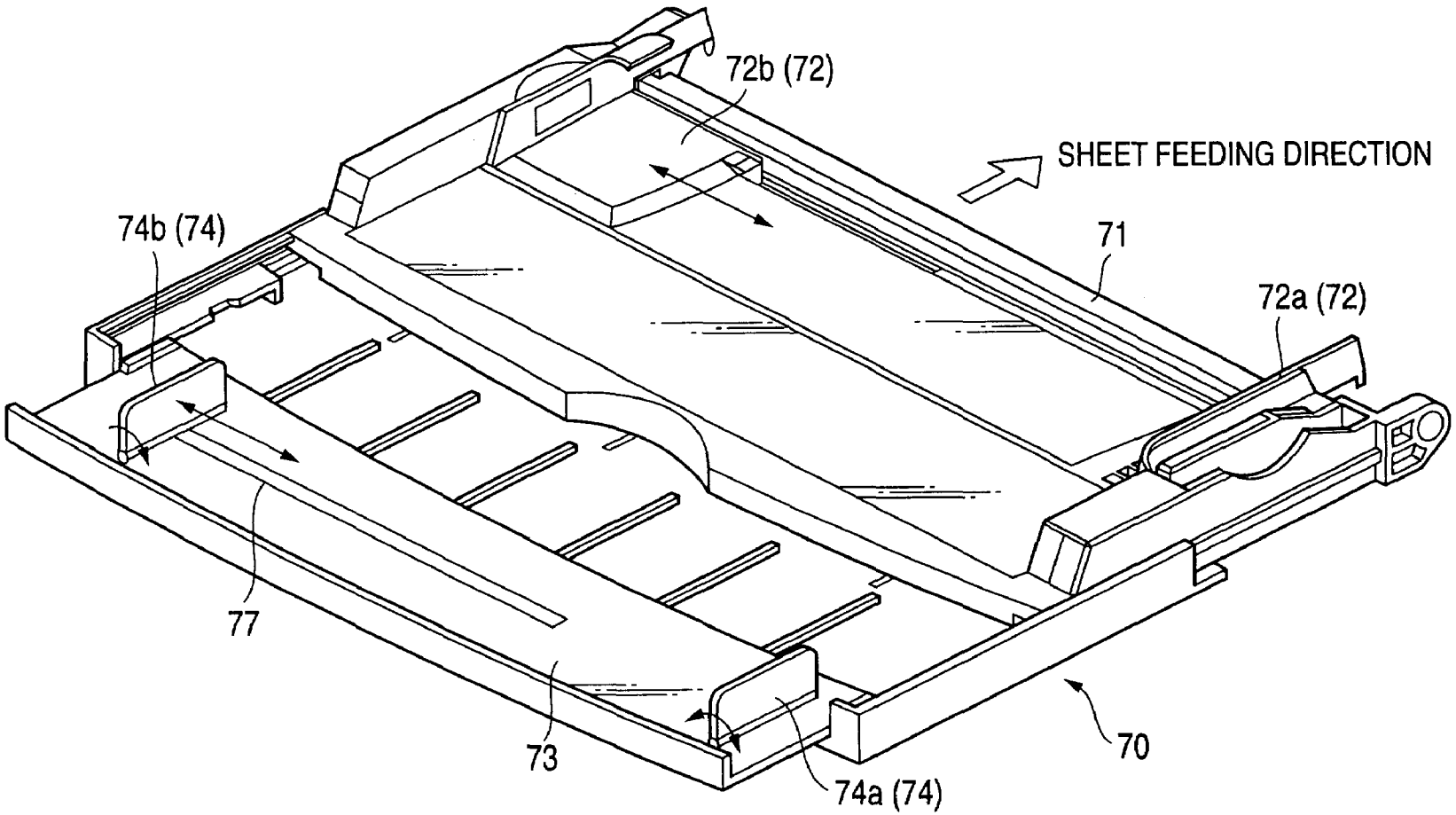
FIG. 11 is a perspective view showing a sheet supply unit for use in the second embodiment.

In addition, in the above configured embodiment, the manual sheet insertion type sheet supply unit 70 has a standard sheet tray 71, standard side guides 72, an extension sheet tray 73 and assistant side guides 74 as shown in FIGS. 9 and 11. The standard side guides 72 are provided on the standard sheet tray 71 so as to regulate the width-direction positions of sheets loaded thereon. The extension sheet tray 73 is provided extensibly on the sheet-feeding-direction upstream side of the standard sheet tray 71. The assistant side guides 74 are provided on the extension sheet tray 73 so as to regulate the width-direction positions of sheets loaded thereon.

Figure 12A:
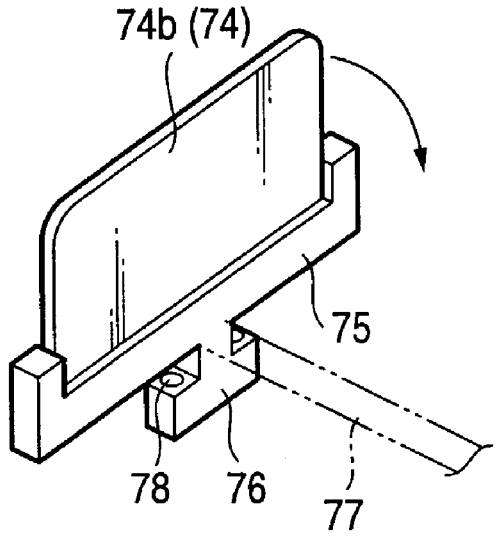
FIGS. 12A and 12B is an explanatory view showing an example of a support structure for assistant side guides.
Figure 12B:
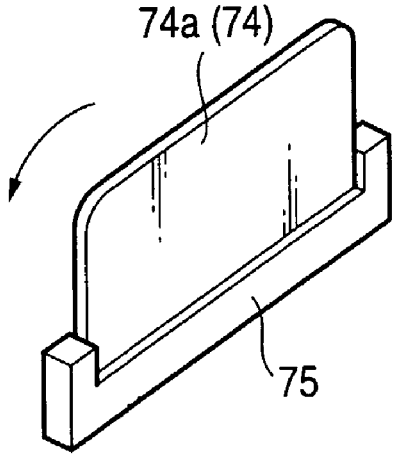

In above configured embodiment, as shown in FIGS. 11, 12A and 12B, the standard side guides 72 include a fixed side guide 72*a* and a movable side guide 72*b* which can be moved desirably in the width direction of the sheets, for example, so as to regulate the positions of the feeding-direction front-end-side opposite sides of the long sheets.

On the other hand, as shown in FIGS. 11, 12A and 12B, the assistant side guides 74 include a fixed side guide 74*a* and a movable side guide 74*b* which can be moved desirably in the width direction of the sheets, for example, so as to regulate the positions of the feeding-direction rear-end-side opposite sides of the long sheets.

Incidentally, in the second embodiment, each of the assistant side guides 74 is designed to be folded desirably in a predetermined direction with respect to a support holder 75. For example, as for the fixed side guide 74*a*, the support holder 75 is fixedly attached to the extension sheet tray 73. On the other hand, the movable side guide 74*b*, for example, has an inverted-T guide shoe 76 provided in the support holder 75 and slidably attached to a guide slit 77 formed in the extension sheet tray 73. Incidentally, the reference numeral 78 represents a holding spring for elastically holding the guide shoe 76 and the guide slit 77 relatively to each other.

Thus, according to the second embodiment, the long sheets S are loaded on the manual sheet insertion type sheet supply unit 70 as follows. That is, as shown in FIGS. 9 and 11, the extension sheet tray 73 is extended from the standard sheet tray 71, and the assistant side guides 74 on the extension sheet tray 73 are then erected from their folded state. After that, the long sheets S are loaded on the extended sheet trays 71 and 73, and the positions of the front, rear and opposite sides of the long sheets S are regulated by the standard side guides 72 and the assistance side guides 74.

In this state, the long sheets S loaded on the manual sheet insertion type sheet supply unit 70 are set on the sheet trays 71 and 73 while they are positioned accurately by the respective side guides 72 and 74.

Thus, a long sheet S supplied from the manual sheet insertion type sheet supply unit 70 reaches a secondary transfer portion through the registration rolls 63 in the sheet transport path 25, and is subjected to secondary transfer in the secondary transfer portion as shown in FIG. 9. Thus, the images primary-transferred on the intermediate transfer belt 23 are secondary-transferred onto the long sheet S. After that, the long sheet S is passed through the fixing unit 66 and the sheet discharge rolls 67, and discharged from the sheet discharge port 69 of the body housing 21.

After that, as shown in FIGS. 9 and 10, the long sheet S discharged from the sheet discharge port 69 is pushed into the sheet reception chamber 152 in the discharge/reception unit 150 by the carrying force of the sheet discharge rolls 67. Thus, the long sheet S is discharged and received in the sheet reception chamber 152 in the state where the long sheet S is folded.

For example, when the discharge operation of the long sheets S is terminated thus, a user may open a door provided in the top portion of the discharge/reception unit 150 or may detach the discharge/reception unit 150 itself so as to extract the discharged long sheets on which images have been formed from the discharge/reception unit 150.

In such a course of sheet processing, the posture of the long sheets S supplied is so stable that there is no fear that a failure such as skewing of the long sheets S occurs in transport. Thus, the image quality on the long sheets S is kept excellent.

Incidentally, when the long sheets are not used, the discharge/reception unit 150 may be detached while the discharge tray 68 is used as a standard sheet discharge unit.

In addition, the sheet supply unit or the sheet discharge unit supporting long sheets is not limited to the aforementioned form, but includes various modified forms as follows.

[First Modification]

Figure 13:
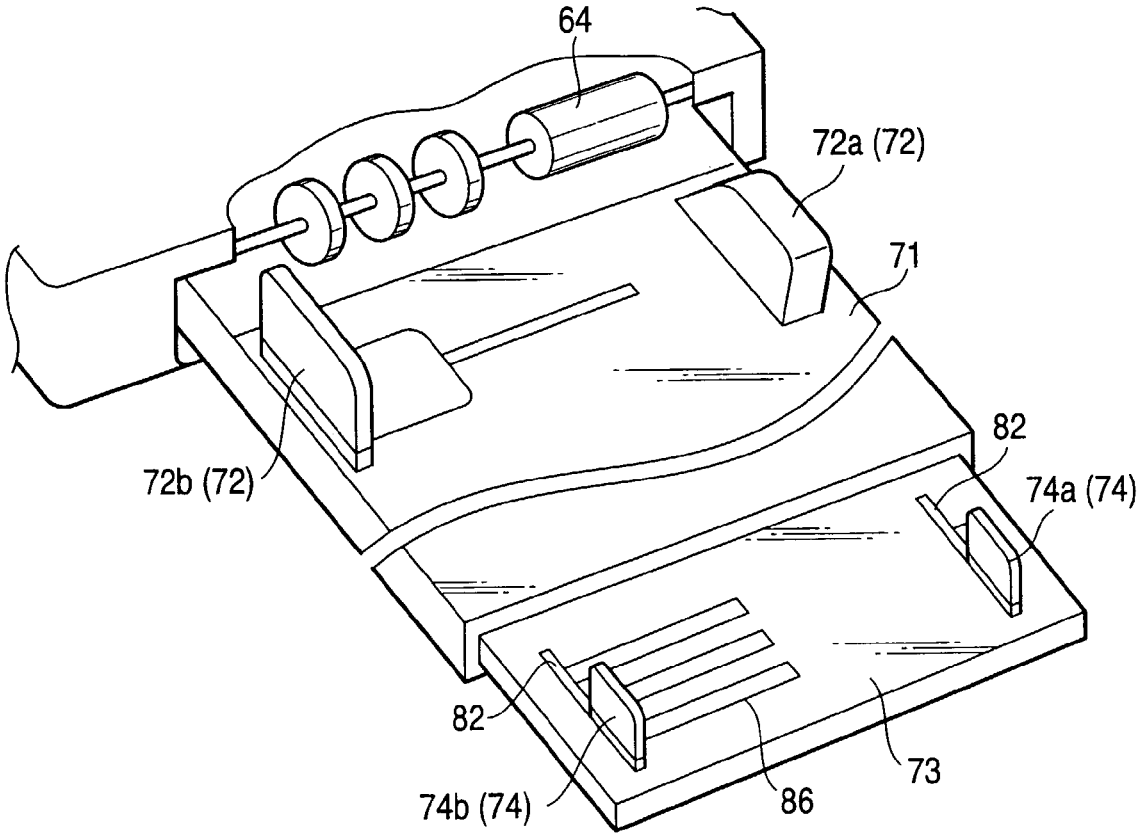
FIG. 13 is an explanatory view showing a first modification of the sheet supply unit.

FIG. 13 shows a first modification of a manual sheet insertion type sheet supply unit.

In FIG. 13, the fundamental configuration of the manual sheet insertion type sheet supply unit is substantially the same as that of the second embodiment, except that the assistant side guides 74 (the fixed side guide 74*a* and the movable side guide 74*b*) are movable in the sheet feeding direction.

Figure 14A:
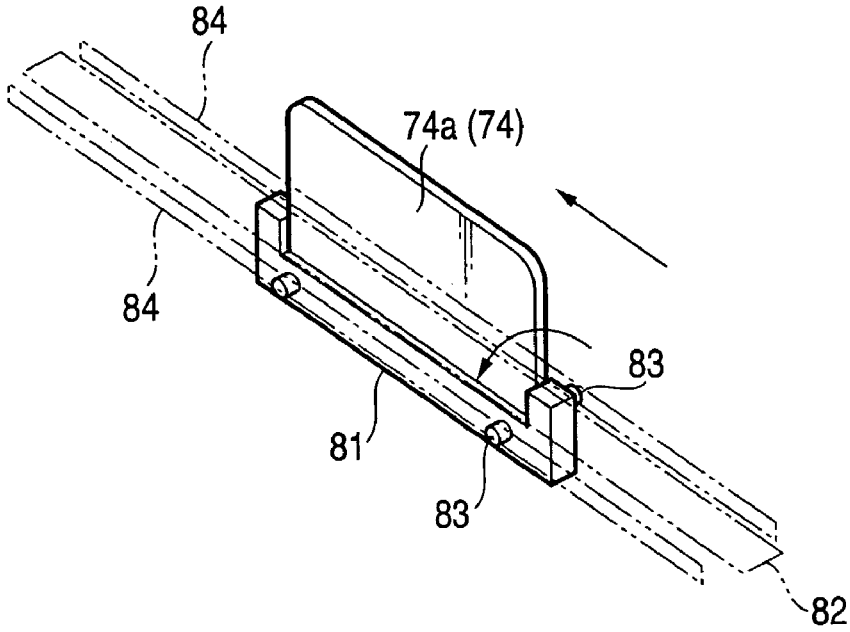
FIGS. 14A and 14B are explanatory views showing an example of a support structure for assistant side guides in the first modification.

For example, of the assistant side guides 74, the fixed side guide 74*a* whose side position is fixed has a support structure as shown in FIG. 14A. That is, the fixed side guide 74*a* is foldably supported on a support holder 81. The support holder 81 is disposed movably along a feeding-direction guide slit 82 extending in the sheet feeding direction. A predetermined number of engagement pins 83 are formed in the support holder 81 so as to project thereon. On the other hand, engagement grooves 84 slidably engaged with the engagement pins 83 are formed in the inner wall of the feeding-direction guide slit 82. Thus, the fixed side guide 74*a* is made movable along the feeding-direction guide slit 82.

Figure 14B:
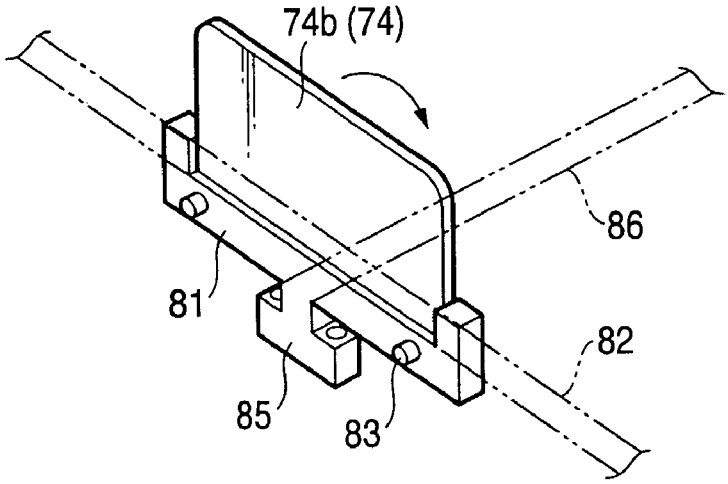

On the other hand, for example, the movable side guide 74*b* whose side position is movable has a support structure as shown in FIG. 14B. That is, the movable side guide 74*b* is foldably supported on a support holder 81. The support holder 81 is engaged with a feeding-direction guide slit 82 (with not-shown engagement grooves) slidably along the feeding-direction guide slit 82. The feeding-direction guide slit 82 is formed in the extension sheet tray 73. On the other hand, a guide shoe 85 is further formed on the support holder 81. The guide shoe 85 is slidably engaged with one of a predetermined number of (three in the embodiment) width-direction guide slits 86 formed in the extension sheet tray 73 and extending in the width direction thereof. Thus, the movable side guide 74*b* is made movable along the feeding-direction guide slit 82 and the width-direction guide slits 86.

Thus, according to the above configured modification, the assistant side guides 74 are formed movably in the sheet feeding direction so that the assistant side guides 74 can be moved and set in most suitable positions in accordance with the size of the long sheets. In comparison with the second embodiment, various sizes of long sheets can be supported in this modification.

[Second Modification]

Figure 15:
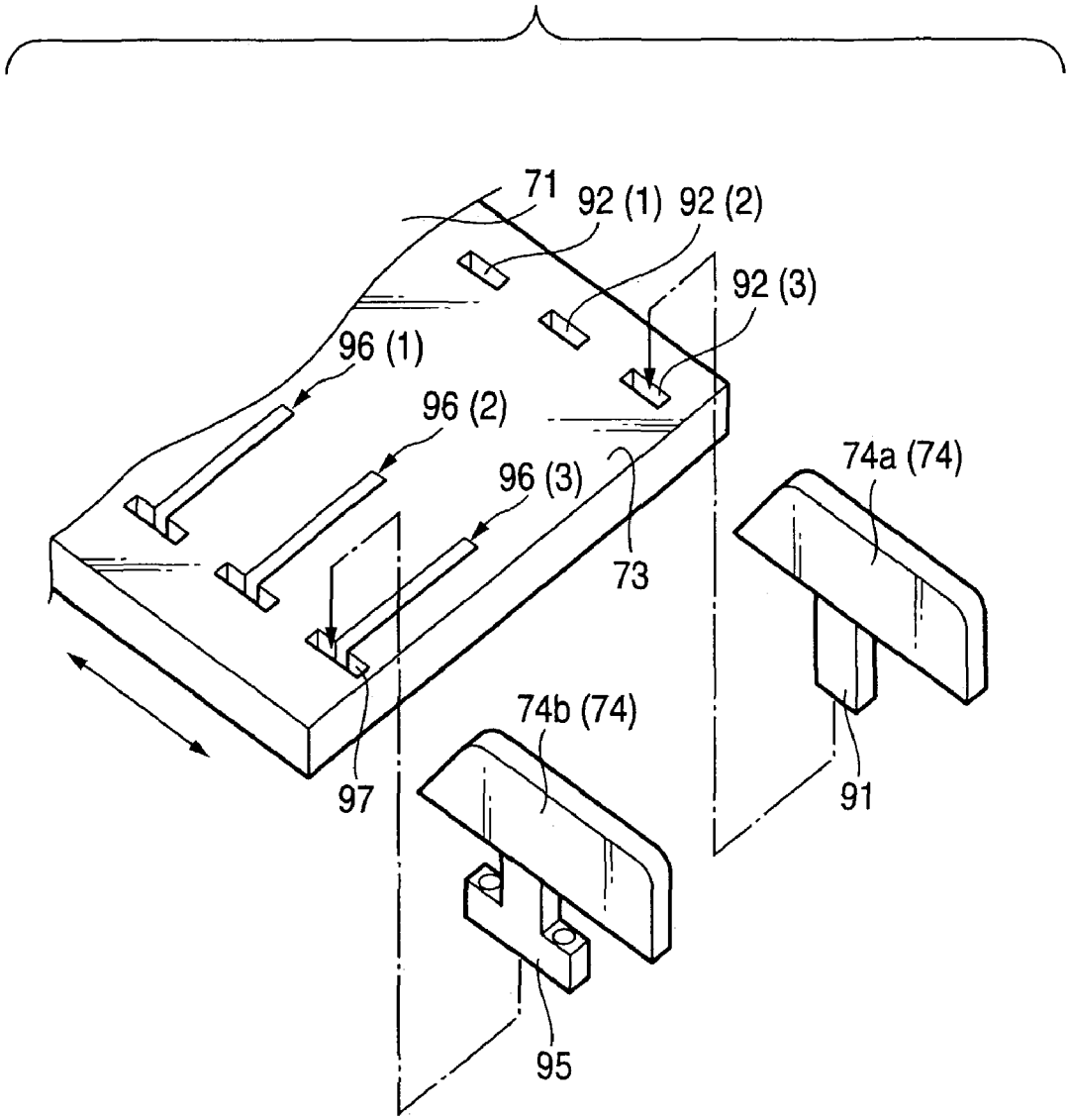
FIG. 15 is an explanatory view showing a second modification of the sheet supply unit.

FIG. 15 shows a second modification of a manual sheet insertion type sheet supply unit.

In FIG. 15, the fundamental configuration of the manual sheet insertion type sheet supply unit is substantially the same as that in the first modification, except that the assistant side guides 74 (the fixed side guide 74*a* and the movable side guide 74*b*) can be disposed in a plurality of positions in the sheet feeding direction.

That is, in the second modification, of the assistant side guides 74, the fixed side guide 74*a* has a support structure as follows. That is, an engagement protrusion piece 91 extending downward is formed in the lower end of the fixed side guide 74*a*. On the other hand, a plurality of (three in the embodiment) engagement holes 92 (specifically 92(1)-92(3)) are provided in the sheet feeding direction in the extension sheet tray 73. The fixed side guide 74*a* can be engaged with any one of the engagement holes 92 desirably.

On the other hand, the movable side guide 74*b* has a support structure as follows. That is, for example, an inverted-T guide shoe 95 is formed in the lower end of the movable side guide 74*b*. On the other hand, a plurality of (three in the embodiment) guide slits 96 (specifically 96(1)-96(3)) are provided in the extension sheet tray 73 so as to be disposed in parallel in the sheet feeding direction. The movable side guide 74*b* can be engaged with any one of the guide slits 96 desirably. Incidentally, an insertion groove 97 for inserting the guide shoe 95 therein is formed in one end of each guide slit 96.

Thus, according to this modification, each assistant side guide 74 can be disposed in a plurality of positions in the sheet feeding direction so that the assistant side guide 74 can be selectively set in a most suitable position in accordance with the size of long sheets. Thus, in the second modification, various sizes of long sheets can be supported in the same manner as in the first modification.

Incidentally, a plurality of pairs of assistant side guides 74 themselves may be provided. In the above configured case, in order to position the assistant side guides 74 more easily, the plurality of pairs of assistant side guides 74 maybe interlocked with one another by a not-shown interlocking mechanism.

[Third Modification]

Figure 16:
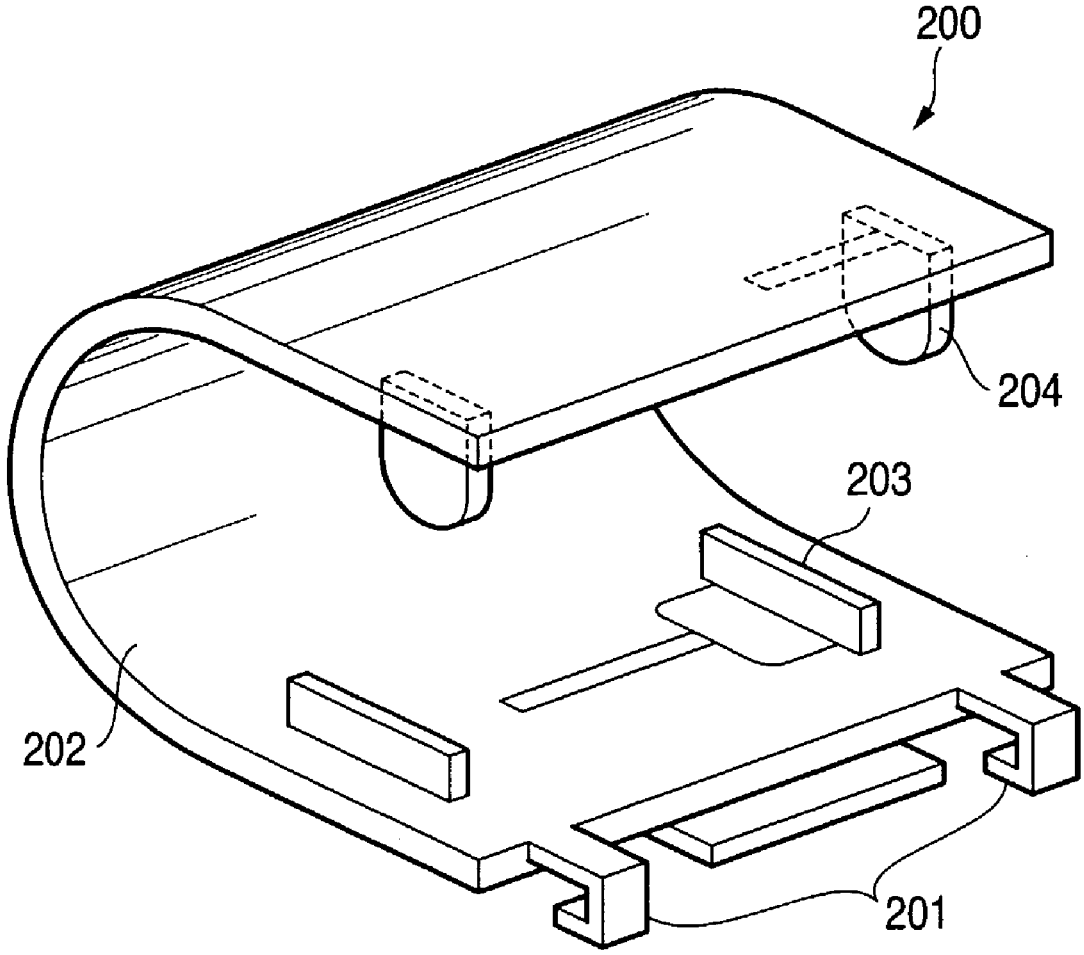
FIG. 16 is an explanatory view showing a main portion of a second modification of the sheet supply unit.

FIG. 16 shows a main portion of a third modification of a manual sheet insertion type sheet supply unit.

The manual sheet insertion type sheet supply unit according to the third modification has an extension sheet tray 200 different from those in the second embodiment and the first and the second modifications.

The extension sheet tray 200 has joint pieces 201, a substantially U-shaped sheet loading surface 202, and assistant side guides 203 and 204. The joint pieces 201 are detachably joined to the rear end of the standard sheet tray 71 (see FIG. 11). The assistant side guides 203 and 204 are provided in the upper and lower portions of the sheet loading surface 202 respectively.

Thus, according to the third modification, when long sheets are supplied, the extension sheet tray 200 is attached to the standard sheet tray 71.

At this time, the positions of the long sheets are regulated accurately by the assistant side guides 203 and 204 while the rear end portions of the long sheets are attached to the U-shaped sheet loading surface 202 of the extension sheet tray 200.

On the other hand, when long sheets are not used, the extension sheet tray 200 may be detached from the standard sheet tray 71 in advance.

[Fourth Modification]

Figure 17B:
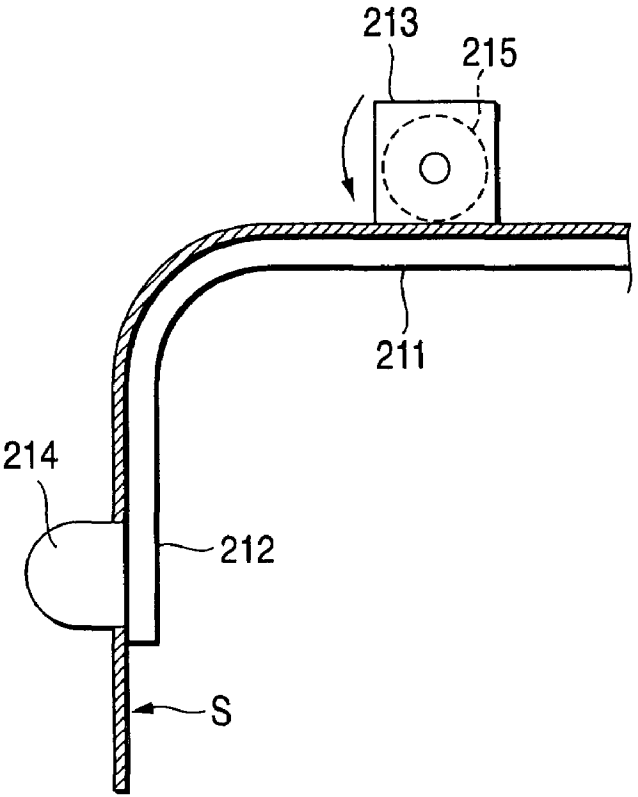
FIG. 17B is a sectional view taken in direction B in FIG. 17A.
Figure 17A:
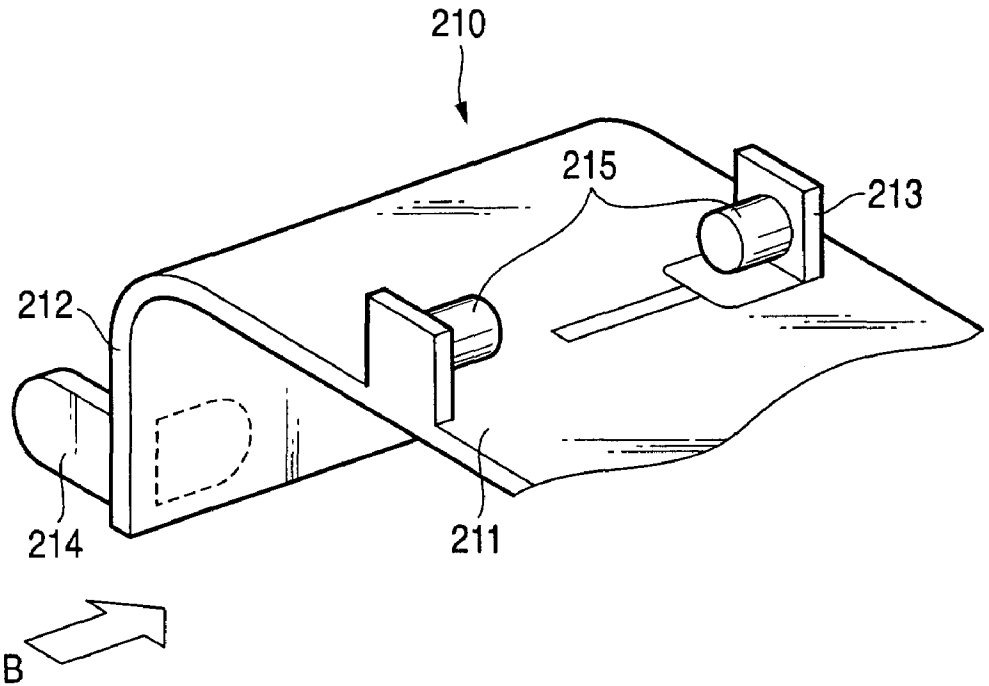
FIG. 17A is an explanatory view showing a main portion of a fourth modification of the sheet supply unit.

FIGS. 17A and 17B show a main portion of a fourth modification of a manual sheet insertion type sheet supply unit.

The manual sheet insertion type sheet supply unit according to the fourth modification has an extension sheet tray 210 different from those in the second embodiment and the first to third modification.

The-extension sheet tray 210 has joint pieces (not shown), a horizontal portion 211, a dropping portion 212, assistant side guides 213 and 214, and pressure rolls 215. The joint pieces are detachably joined to the rear end of the standard sheet tray 11 (see FIG. 11). The dropping portion 212 drops downward gradually from the horizontal portion 211. The assistant side guides 213 and 214 are provided on the horizontal portion 211 and the dropping portion 212 respectively. For example, a one-way clutch is built in each of the pressure rolls 215 provided on the assistant side guides 213 on the horizontal portion 211. Thus, long sheets are held to be prevented from falling.

Thus, according to the fourth modification, when long sheets are supplied, the extension sheet tray 210 is attached to the standard sheet tray 71.

At this time, the rear end portions of the long sheets drop on the extension sheet tray 210 ranging from the horizontal portion 211 to the dropping portion 212, but the long sheets are held by the holding action of the pressure rolls 215 so as to be prevented from falling. In addition, the positions of the long sheets are regulated accurately by the assistant side guides 213 and 214.

On the other hand, when long sheets are not used, the extension sheet tray 210 may be detached from the standard sheet tray 71 in advance.

[Fifth Modification]

Figure 18:
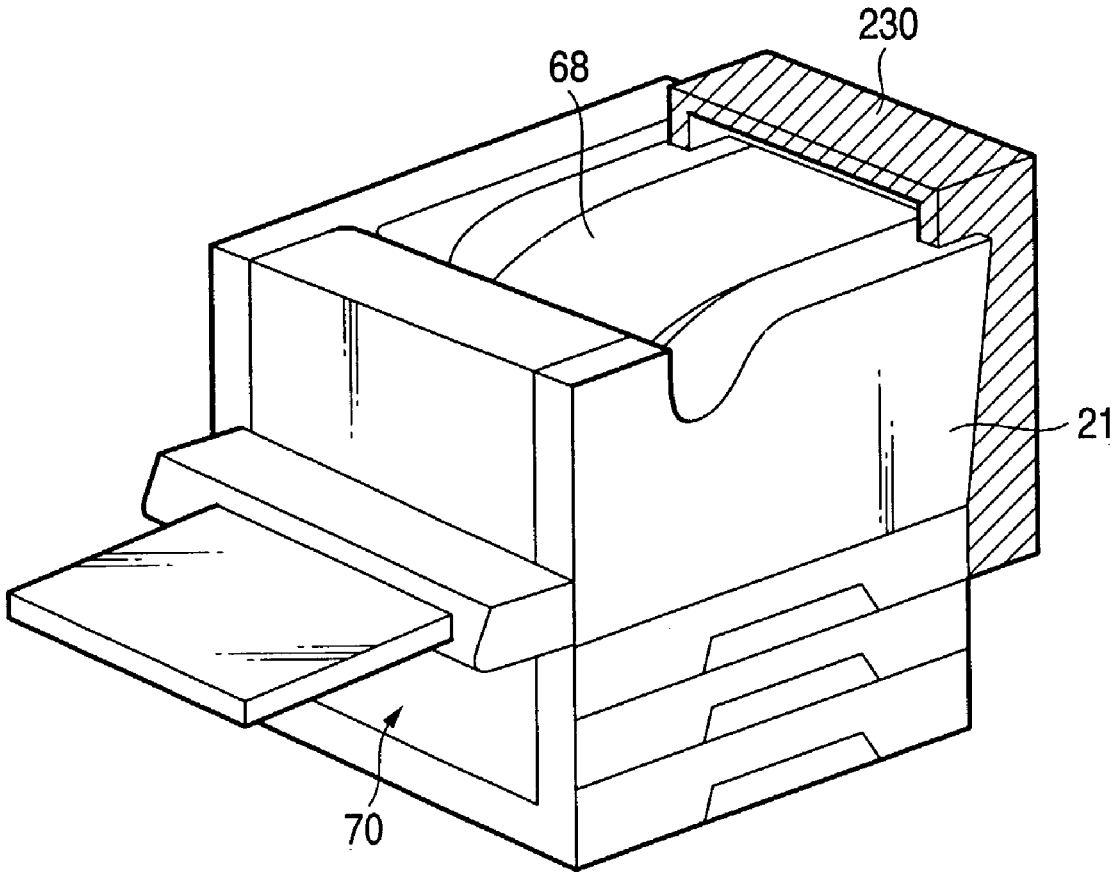
FIG. 18 is an explanatory view showing a fifth modification of the sheet discharge unit for use in the sheet processing apparatus according to the second embodiment.

The discharge tray 68 is used directly as a sheet discharge unit in the second embodiment and the first to fourth modification. In order to keep the long sheet discharge/reception property in better condition, however, a discharge/reception unit 230 may be provided adjacently to the discharge tray 68, for example, as shown in FIG. 18. Thus, the long sheet discharge/reception property is improved by means of the discharge tray 68 and the discharge/reception unit 230.

Third Embodiment

Figure 19:
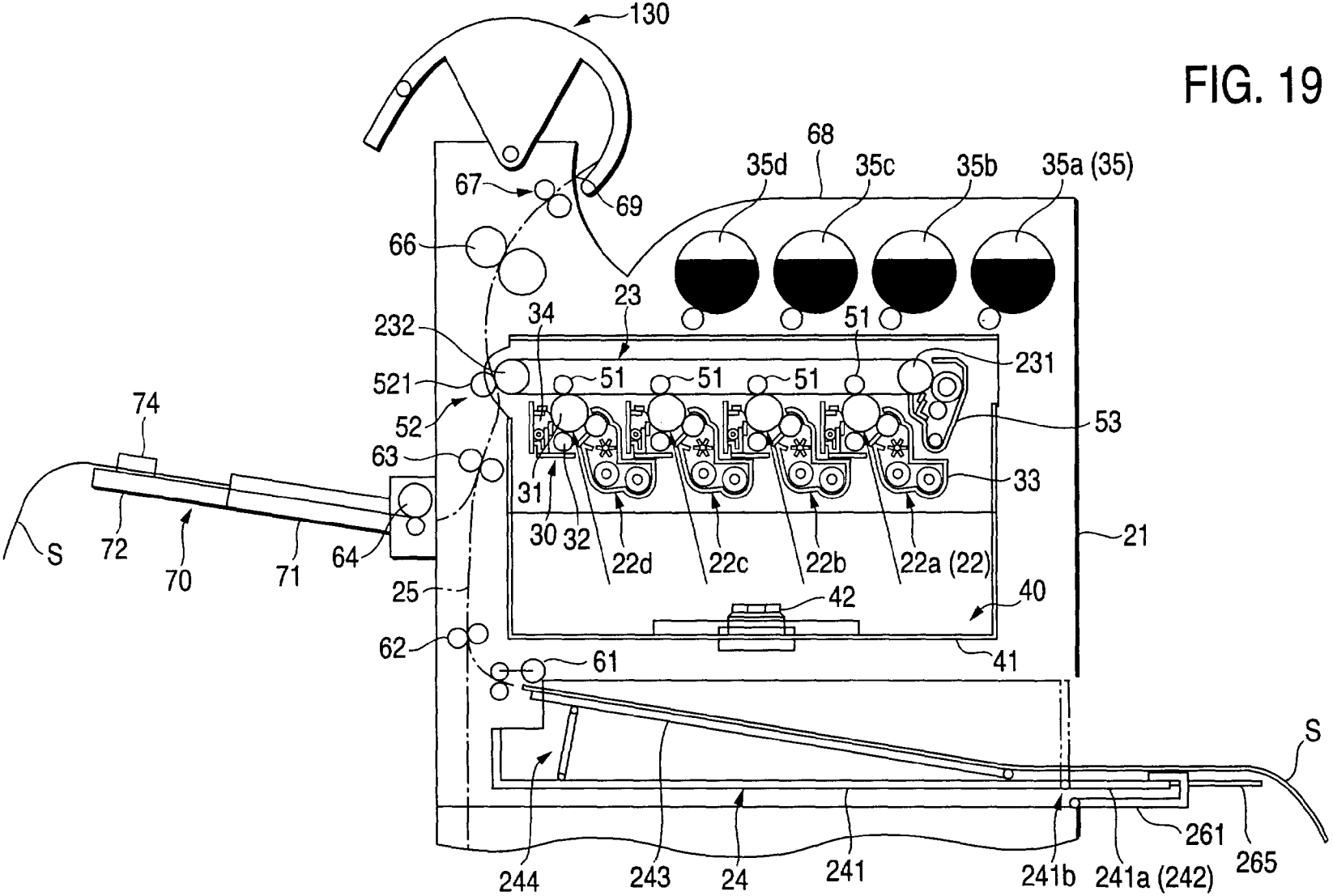
FIG. 19 is an explanatory view showing the whole configuration of image forming apparatus as sheet processing apparatus according to a third embodiment.

FIG. 19 is an explanatory view showing a third embodiment of tandem type image forming apparatus as sheet processing apparatus to which the invention is applied.

In FIG. 19, the fundamental configuration of the tandem type image forming apparatus has substantially the same configuration as that of the first embodiment, except that a cassette type sheet supply unit (corresponding to the sheet supply cassette) 24 is designed to support long sheets, and the manual sheet insertion type sheet supply unit 70 in the second embodiment is used also as a sheet discharge unit.

Incidentally, constituent components similar to those in the first and second embodiments are denoted by the same reference numbers as those in the first embodiment correspondingly, and detailed description thereof will be omitted here.

Figure 20A:
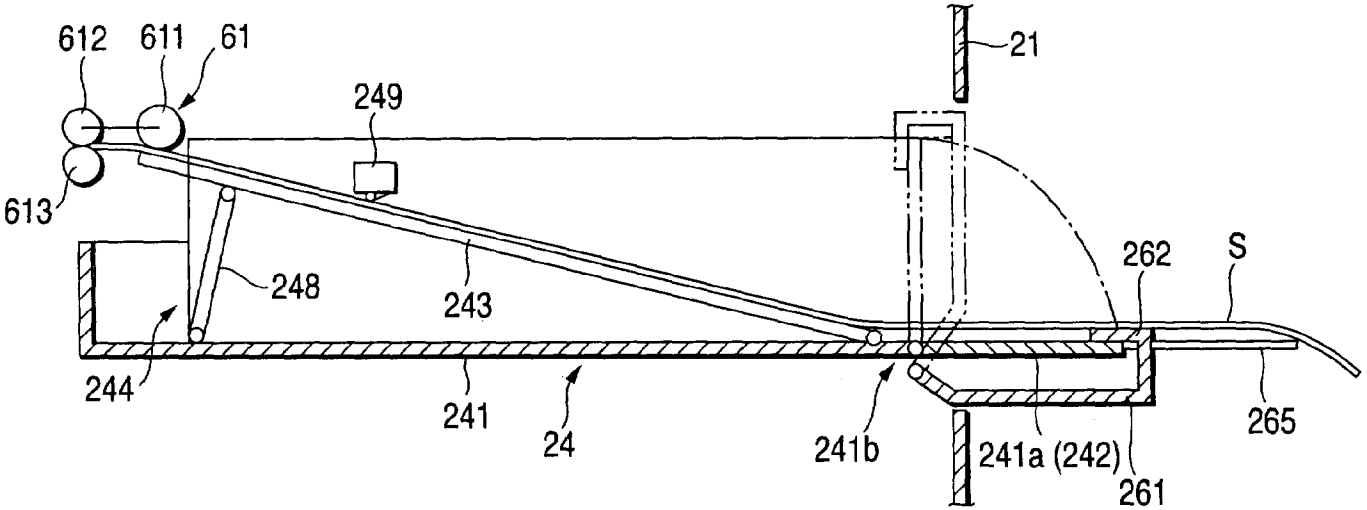
FIG. 20A is an explanatory view showing a sheet supply unit for use in the third embodiment.

In the third embodiment, the cassette type sheet supply unit 24 is configured as shown in FIG. 19 and FIG. 20A. That is, a cassette body 241 which can receive standard size sheets is used as a standard sheet tray. A wall portion 241*a* of the cassette body 241 opposite to the sheet feeding side is designed to be erectable/reclinable around a rotating shaft 241*b*. When the wall portion 241*a* is reclined, the cassette body 241 functions as an extension sheet tray 242.

In the cassette type sheet supply unit 24, as shown in FIGS. 19 and 20A, a feeder 61 (for example, arranged as a unit for picking up sheets by a nudger roll 611, and then managing and delivering the sheets one by one by a feed roll 612 and a retard roll 613) is provided on the sheet-feeding-direction side of the cassette body (standard sheet tray) 241. In addition, a bottom plate 243 is provided in the cassette body 241 movably up and down with the sheet-feeding-direction upstream side of the cassette body 241 functioning as a swinging fulcrum.

Figure 21:
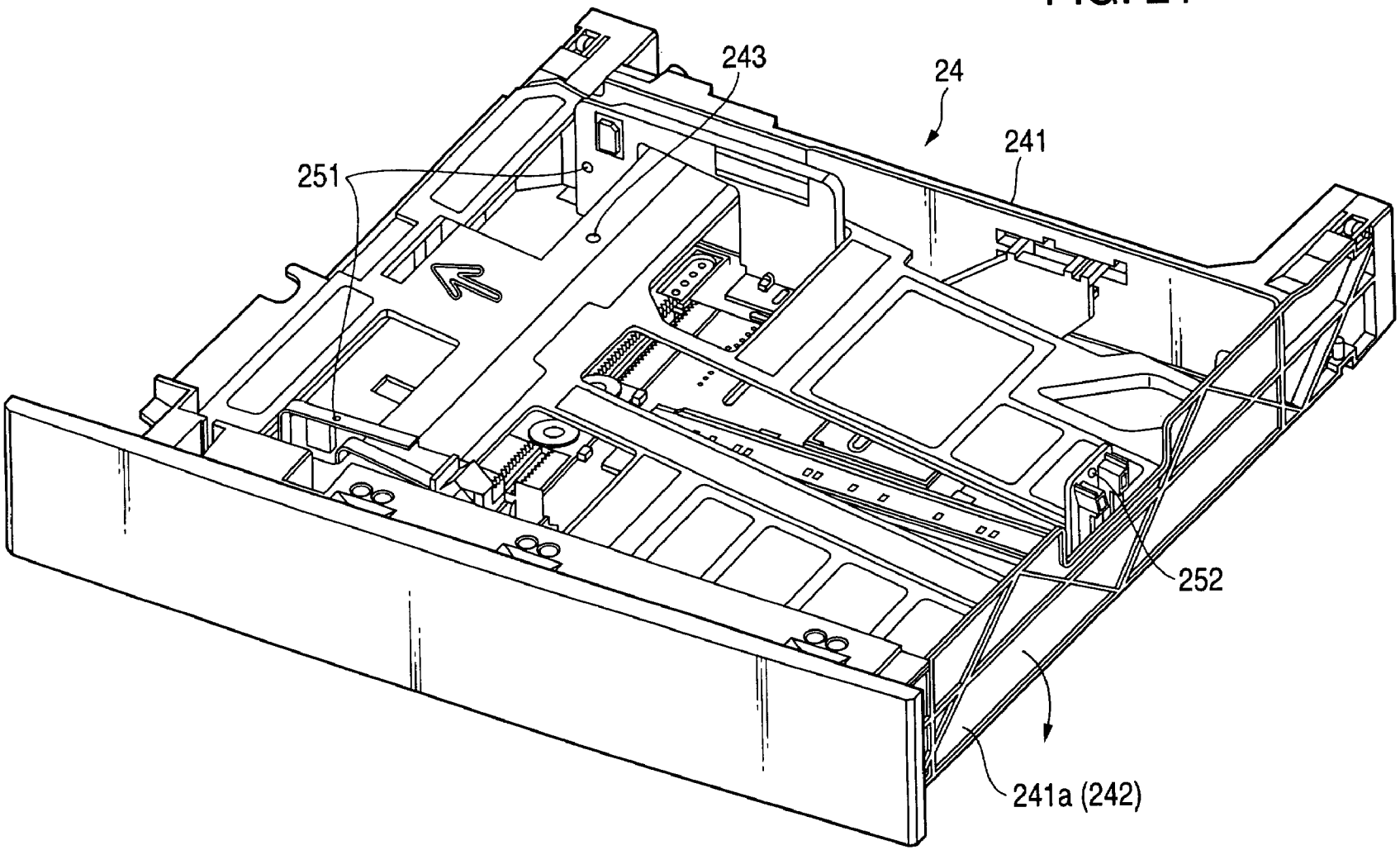
FIG. 21 is a perspective view showing the outline of the sheet supply unit for use in the third embodiment.
Figure 22:
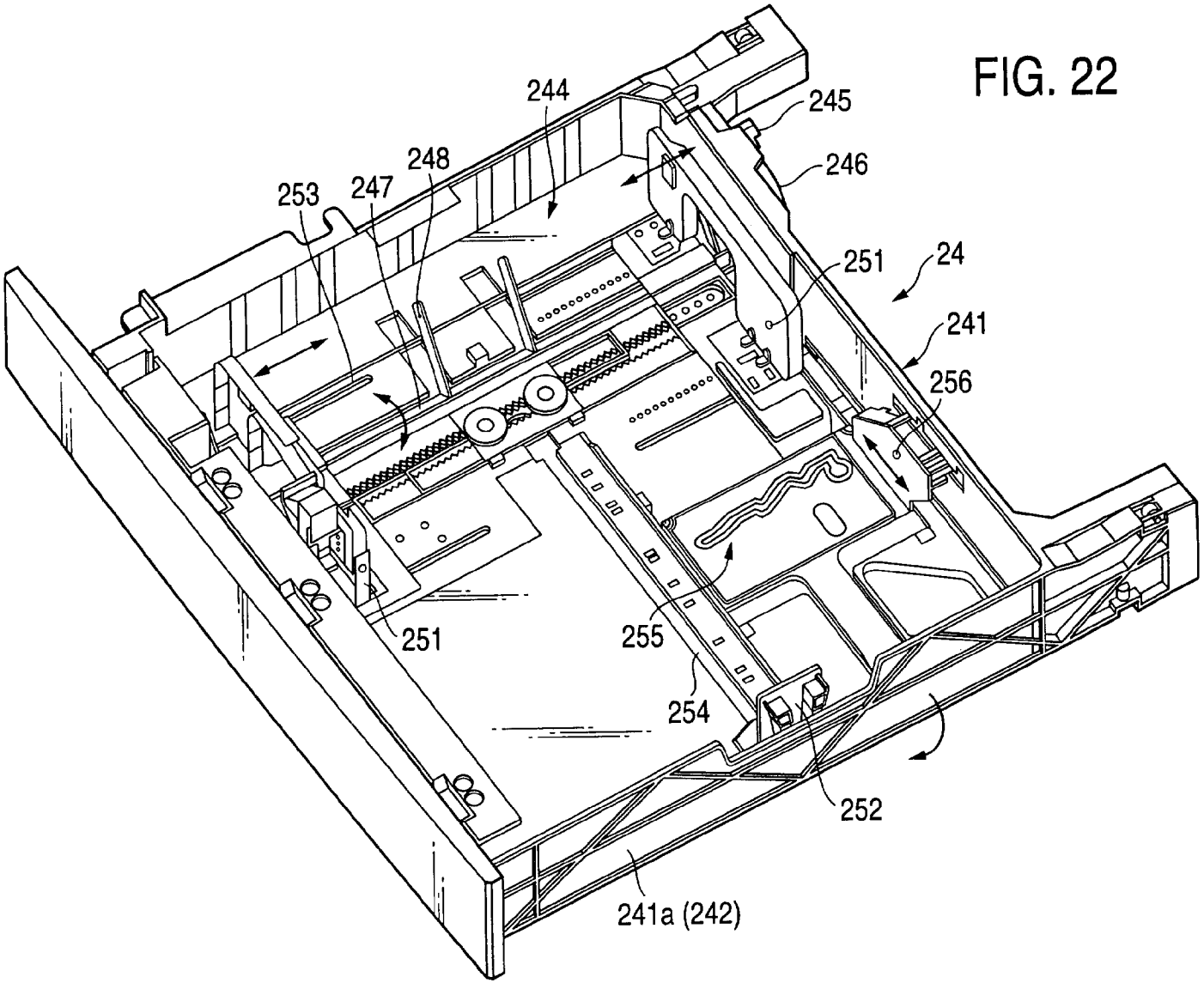
FIG. 22 is an explanatory view showing the state where a bottom plate has been removed from FIG. 21.
Figure 23:
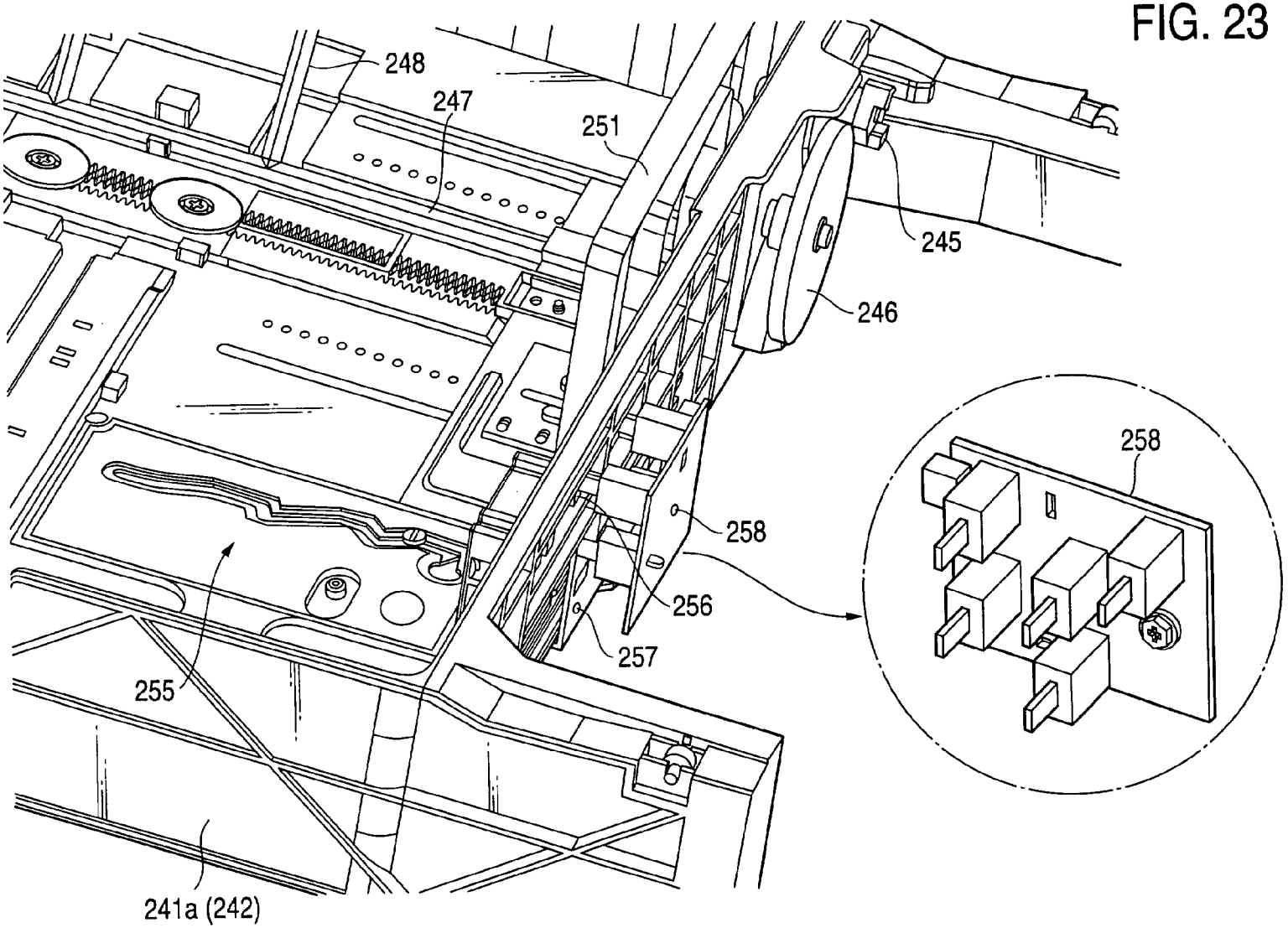
FIG. 23 is an explanatory view showing an example of the configuration of a size detection mechanism in the sheet supply unit for use in the third embodiment.
Figure 30:
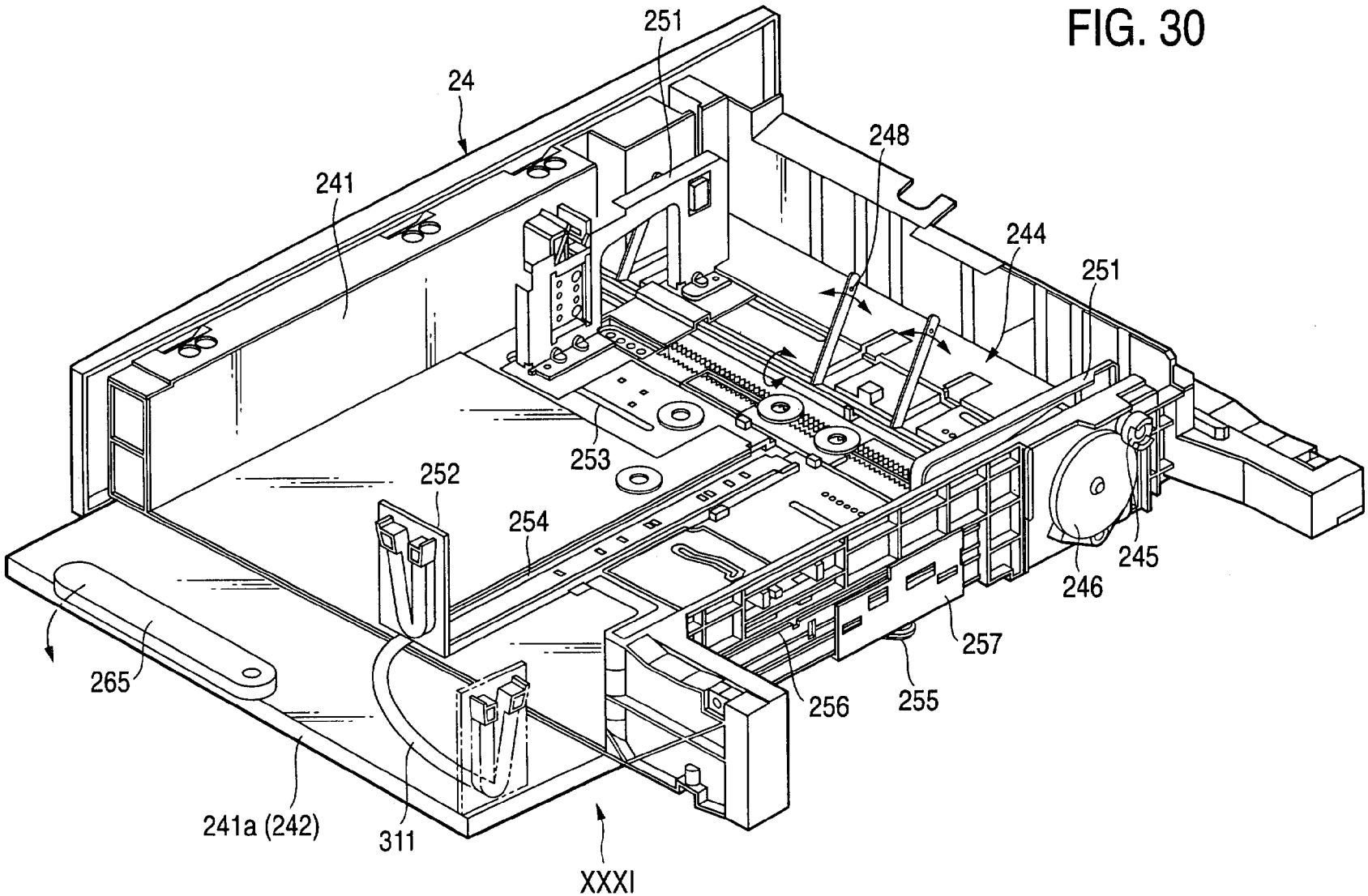
FIG. 30 is an explanatory view showing another example of making detection that the sheet supply unit for use in the third embodiment has been set for extension.

Here, a lifting mechanism 244 for the bottom plate 243, for example, as shown in FIGS. 21 through 23, transmits driving power from a driving input coupling 245 (see FIG. 30) to a tongue shaft 247 through a gear 246 (see FIG. 30). For example, the lifting mechanism 244 has a pair of protrusion pieces 248 projecting in the radial direction of the tongue shaft 247. Thus, the swingable free-end side of the bottom plate 243 is supported movably up and down by the projecting pieces 248.

In addition, the reference numeral 249 in FIG. 20A represents a sheet presence/absence sensor for judging the presence/absence of a sheet on the bottom plate 243. For example, the sheet presence/absence sensor 249 is provided on the upper side of the bottom plate 243 in the cassette body 241, and the sheet presence/absence sensor 249 includes an actuator operating in abutment against the sheet on the bottom plate 243.

Further, in the third embodiment, the cassette type sheet supply unit 24 has standard side guides 251 and a standard end guide 252 in the cassette body 241. The standard side guides 251 regulate the lateral positions of standard size sheets received therein. The standard end guide 252 regulates the rear position (sheet-feeding-direction upstream position) of the sheets. The guides 251 and 252 are moved slidably along their corresponding guide slits 253 and 254 in accordance with each sheet size respectively.

In the third embodiment, when the guides 251 and 252 move respectively, side guide actuators 256 and 257 are moved interlocking with the guides 251 and 252 through a give link mechanism (formed out of a link arm, a cam pattern groove for regulating the motion of the link arm, and so on) 255, respectively, as shown in FIGS. 21 to 23. Thus, a predetermined contact point of a size detection sensor 258 is pressed so that the size detection sensor 258 can detect the sheet size.

Figure 24A:
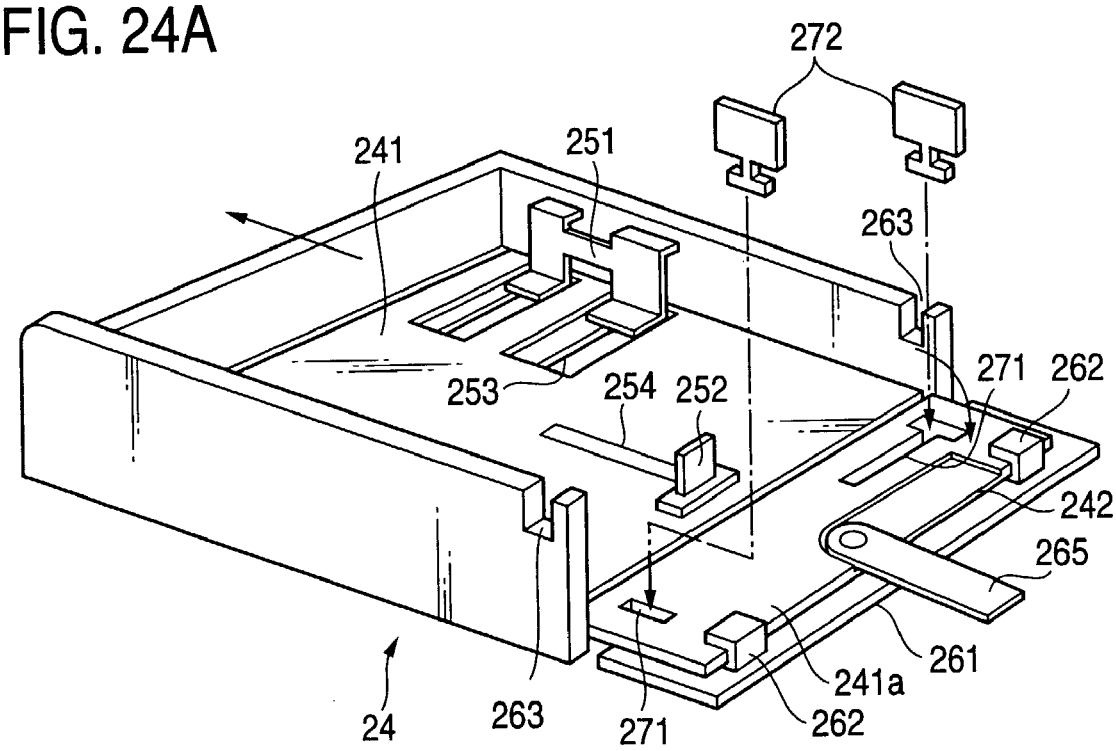
FIG. 24A is an explanatory view showing an example of the extension configuration of the sheet supply unit for use in the third embodiment.
Figure 24B:
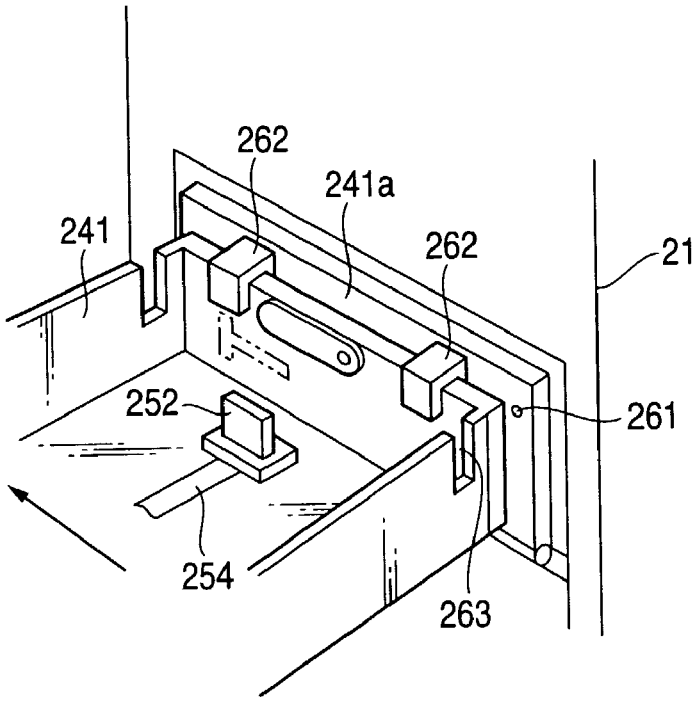
FIG. 24B is a main portion perspective view showing the state of the sheet supply unit before extension.

Particularly, in the third embodiment, the cassette type sheet supply unit 24 is designed as shown in FIGS. 24A and 24B. That is, an open/close cover 261 is provided in the body housing 21 corresponding to the wall portion 241*a* (extension sheet tray 242) of the cassette body 241. For example, a pair of hook-like lock claws 262 are formed on the inner surface side of the open/close cover 261. The lock claws 262 are locked in the upper edge portion of the wall portion 241*a* of the cassette body 241. When the open/close cover 261 is opened, the wall portion 241*a* is reclined interlocking with the opening of the open/close cover 261. Incidentally, in FIG. 24, the reference numeral 263 represents a notch portion formed by notching a part of a side wall of the cassette body 241 and for locking each lock claw 262 in the wall portion 241*a* of the cassette body 241.

Further, a rotatable rear support bar 265 is additionally provided in the extension sheet tray 242 so as to enhance the portion supporting the rear ends of the long sheets.

Incidentally, as shown by the imaginary line in FIG. 24A, guide mounting portions (engage grooves or guide slits) 271 may be formed on the inner side of the wall portion 241*a* (extension sheet tray 242) so that assistant side guides 272 can be, for example, detachably attached to the guide mounting portions 271.

Further, in the third embodiment, the extension sheet tray 242 is erectable/reclinable with respect to the standard sheet tray 241. A cover open/close switch 281 is used for detecting whether the extension sheet tray 242 has been reclined or not.

Figure 25A:
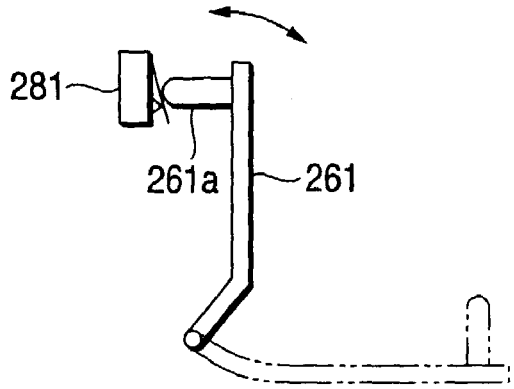
FIG. 25A is an explanatory view showing a specific example of making detection that the sheet supply unit has been set for extension.

The cover open/close switch 281 operates, for example, as shown in FIG. 25A. That is, a protrusion piece 261*a* is provided to project from the open/close cover 261. For example, when the open/close cover 261 is closed, the protrusion piece 261*a* closes the contact point of the cover open/close switch 281.

Figure 25B:
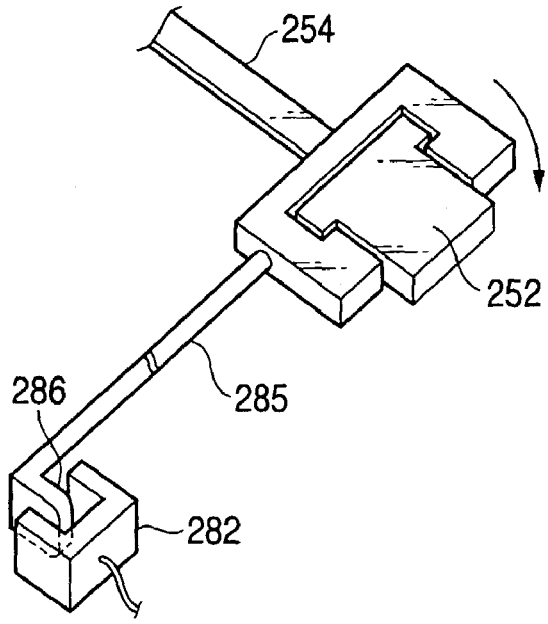
FIG. 25B is an explanatory view showing another specific example thereof.
Figure 25C:
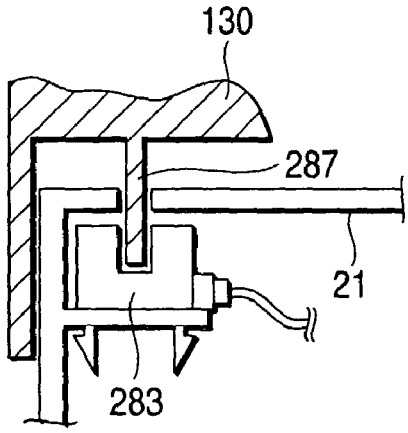
FIG. 25C is an explanatory view showing a specific example of making detection that a discharge guide unit has been attached.

In addition, the following detection system is adopted for detecting whether the extension sheet tray 242 has been set for extension. That is, an end guide 252 is provided to be erectable/reclinable separately from the cover open/close switch 281 or in addition thereto, for example, as shown in FIG. 25B. A detection piece 286 is provided to project from the front end of a transmitting rotary arm 285 which rotates interlocking with the erecting/reclining state of the end guide 252. The optical path of an end cover posture switch 282 such as a photo-coupler is blocked suitably by the detection piece 286. For example, as soon as the detection piece 286 blocks off the end cover posture switch 282, it is grasped that the end guide 252 has a reclined posture. Thus, the state where the extension sheet tray 242 is set for extension is detected indirectly.

Further, in the third embodiment, a discharge guide unit 130 is provided in the body housing 21 as shown in FIG. 19. In the third embodiment, a unit attachment/detachment switch 283 is provided for detecting the attached/detached state of the discharge guide unit 130.

For example, an optical sensor such as a photo-coupler is used as the unit attachment/detachment switch 283. A detection piece 287 is provided in a part of the discharge guide unit 130 so as to project thereon. For example, as soon as the discharge guide unit 130 is attached, an optical path for detection is blocked by the detection piece 287.

In addition, the manual sheet insertion type sheet supply unit 70 used as a sheet discharge unit has a standard sheet tray 71, and an extension sheet tray 73 which is extensible/retractable or attachable/detachable with respect to the standard sheet tray 71. In the above configured embodiment, as soon as the extension sheet tray 73 is extended or attached, a not-shown sensor detects the state where the extension sheet tray 73 is set for extension.

Figure 26:
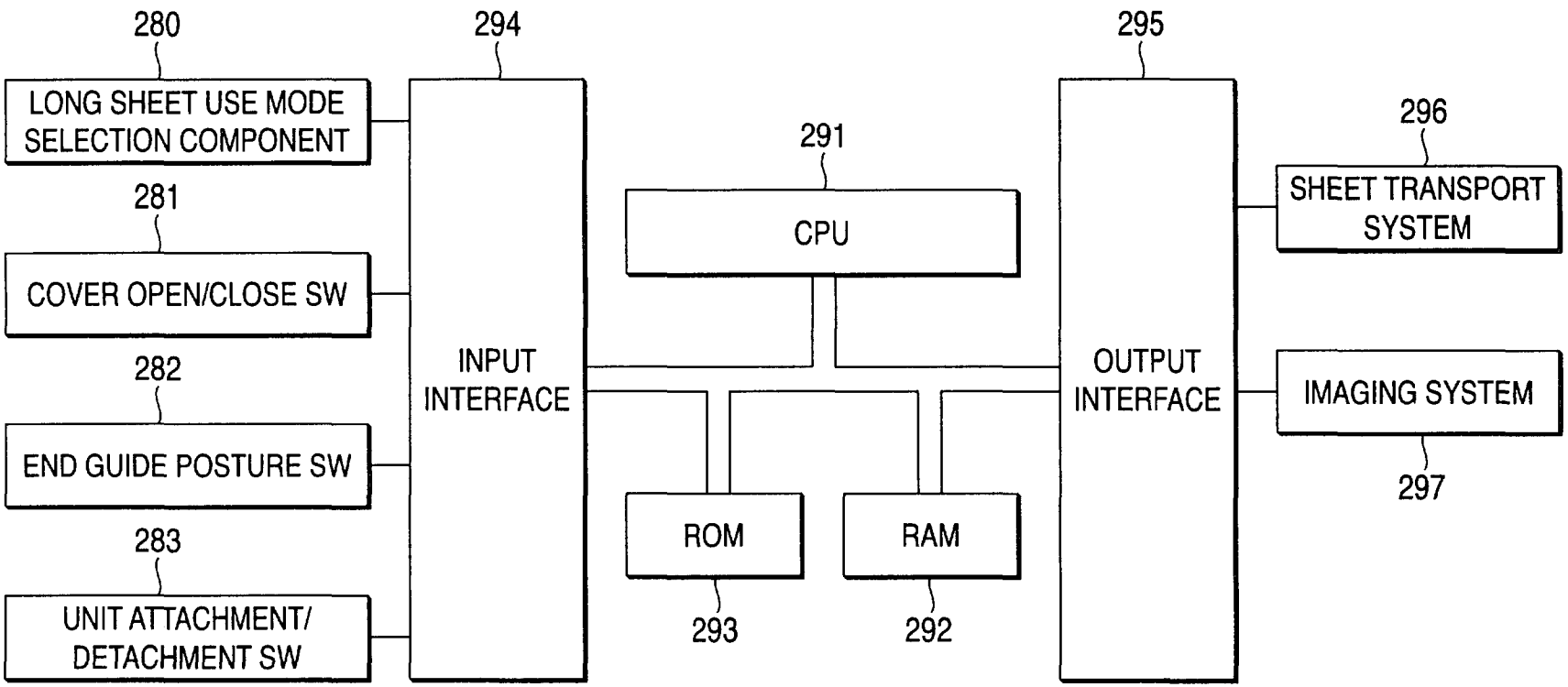
FIG. 26 is a block diagram showing a control/processing system for use in the image forming apparatus according to the third embodiment.

In addition, in the third embodiment, a control/processing system includes a microcomputer system (a CPU 291, a RAM 292, a ROM 293, and input and output interfaces 294 and 295), for example, as shown in FIG. 26. A plurality of software programs such as an imaging program and a sheet transport program (including a long sheet use mode), are stored in the ROM 293 in advance. Signals from a long sheet use mode selecting component (such as UI or printer driver) 280, the cover open/close switch 281, the end guide posture switch 282 and the unit attachment/detachment switch 283 are imported into the CPU 291 through the input interface 294. Various control signals obtained by execution of a given program are sent to a sheet transport system 296 and an imaging system 297 through the output interface 295.

Figure 27:
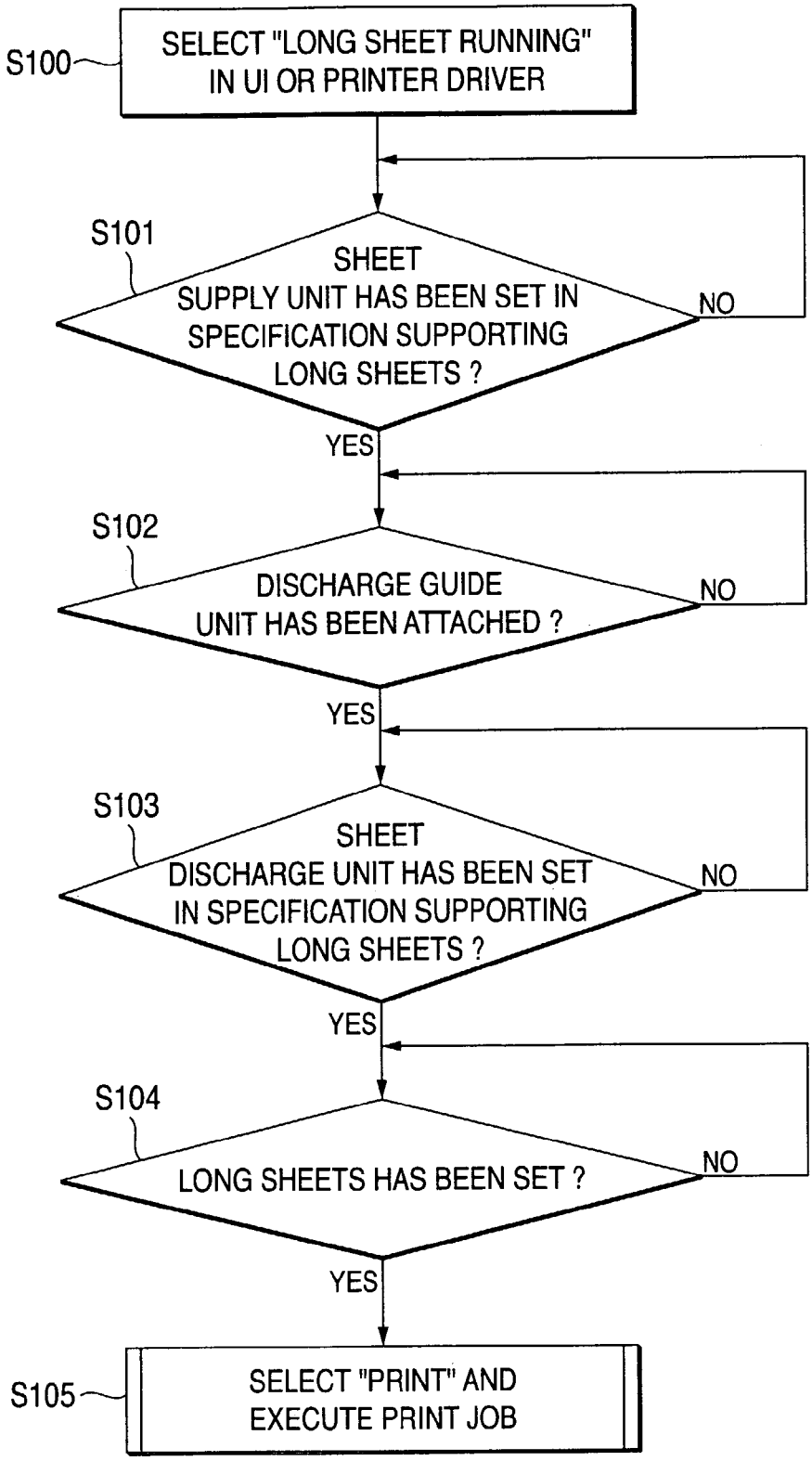
FIG. 27 is a flow chart showing the control/processing procedure thereof.

Incidentally, FIG. 27 shows a flow chart showing the procedure of processing in the long sheet use mode.

Next, description will be made on the operation of the image forming apparatus according to the third embodiment.

Now assume that imaging processing is carried out on a long sheet (long paper). As shown in FIG. 19 and FIGS. 24A and 24B, the cassette type sheet supply unit 24 will go well if the open/close cover 261 is opened to recline the extension sheet tray 242, and further the end guide 252 is reclined while the assistant support bar 265 of the extension sheet tray 242 is pulled out.

Further, as for the manual sheet insertion type sheet supply unit 70 in which the discharge guide unit 130 is attached to the top portion of the body housing 21 so that the manual sheet insertion type sheet supply unit 70 is also used as a sheet discharge unit, it will go well if the extension sheet tray 73 is pulled out in the extending direction with respect to the standard sheet tray 71 or attached thereto.

In order to enable imaging processing with a long sheet in such a manner, it is necessary to perform the aforementioned preparation upon the image forming apparatus.

Here, a user selects an item "long sheet running" through a UI (User Interface) or a printer driver so as to set a long sheet use mode (Step S100).

Figure 28:
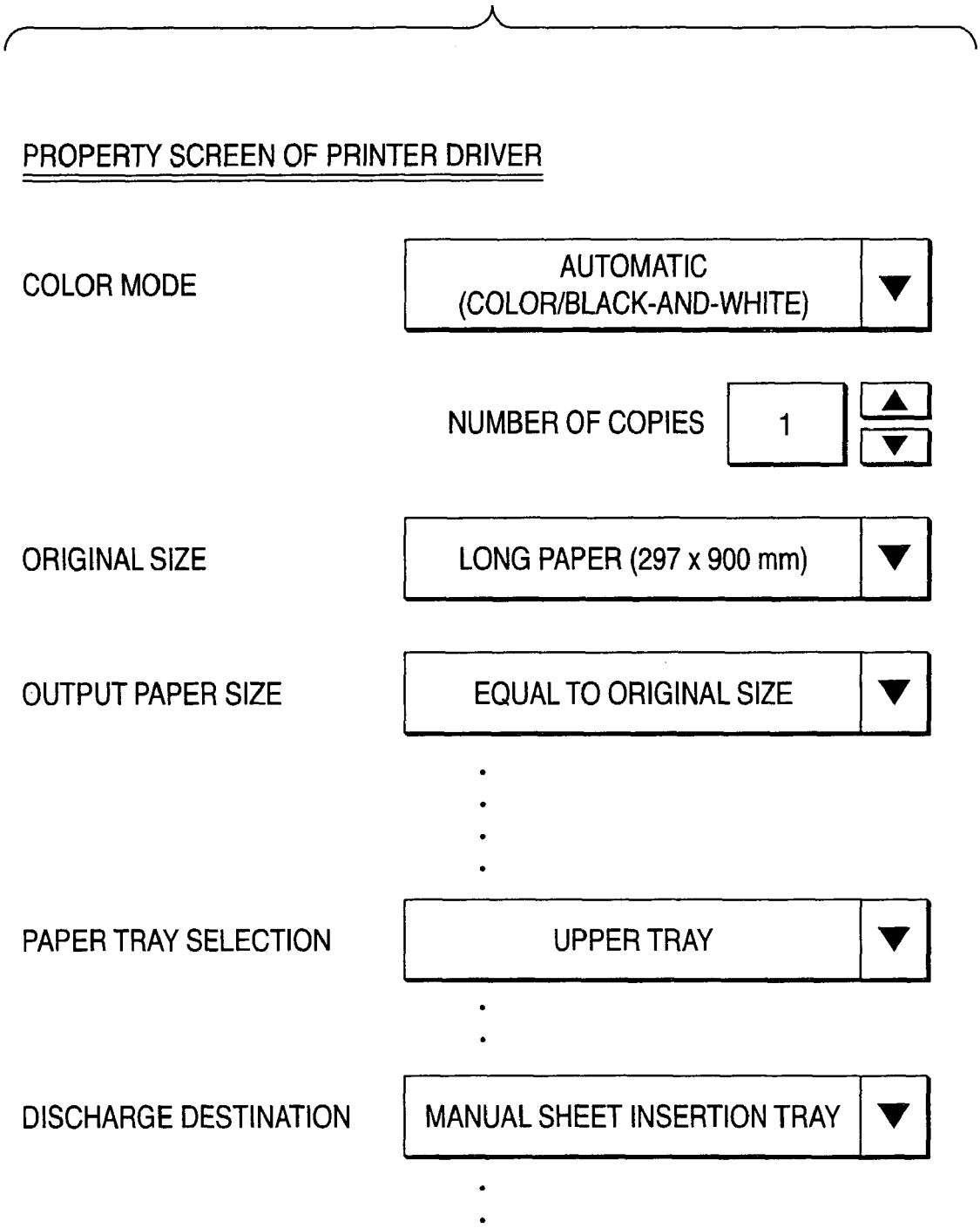
FIG. 28 is an explanatory view showing an example of a property screen of a printer driver.

On this occasion, description will be made on the case where the item "long sheet running" is selected on the property screen of the printer driver by way of example. As shown in FIG. 28, the user may specify items of (1) original size, (2) output paper (sheet) size, (3) paper (sheet) tray choice, and (4) discharge destination.

In this example, items of (1) long paper (long sheet), (2) equal to original size, (3) upper tray, and (4) manual sheet insertion tray (manual sheet insertion type sheet supply unit) are selected (see FIG. 28).

When such a long sheet use mode is selected, the processing/control system checks whether the cassette type sheet supply unit 24 has been set in specification supporting long sheets or not, on the basis of signals from the cover open/close switch 281 and the end guide posture switch 282 (Step S101).

Next, the processing/control system checks whether the discharge guide unit 130 has been attached or not, on the basis of a signal from the unit attachment/detachment switch 283 (Step S102). Further, the processing/control system checks whether the manual sheet insertion type supply unit 70 to be used as a sheet discharge unit has been set in specification supporting long sheets or not, on the basis of a signal from a not-shown sensor (Step S103). Further, the processing/control system checks whether the long sheets S are appropriately set in the cassette type sheet supply unit 24 or not (Step S104).

At this time, when any one of the check items is not satisfied, for example, a warning message is displayed on the UI screen.

When an instruction "print" is issued on the property screen of the printer driver after long sheets S are set in the cassette type sheet supply unit 24 in the state where all the check items have been satisfied, a print job is executed on a long sheet (Step S105).

At this time, a long sheet S set in the cassette type sheet supply unit 24 is delivered by the feeder 61. After that, the long sheet S reaches a secondary transfer portion through the registration rolls 63. On the other hand, images formed by the imaging engine (the respective image forming units 22 and the intermediate transfer belt 23) are sent to the secondary transfer portion. The images formed by the imaging engine are transferred to the long sheet S in the secondary transfer portion.

After that, the long sheet S is passed through the fixing unit 66 and the sheet discharge rolls 67, and discharged from the sheet discharge port 69 of the body housing 21. The long sheet S is discharged to the manual sheet insertion type sheet supply unit 70 as a sheet discharge unit through the discharge guide unit 130.

In such a course of operation, when long sheets are used, the cassette type sheet supply unit 24 is set in specification corresponding to the long sheet use mode.

At this time, the long sheets S are surely loaded and received by the extension sheet tray 242 constituted by the wall portion 241*a* reclined from the cassette body 241, and the rear support bar 265, while the positions of the long sheets S are regulated by the standard side guides 251, and the assistant side guides 272 in accordance with necessity.

In this state, the long sheets are set accurately without skewing. Thus, a failure in transport rarely occurs in the supplied long sheets.

Figure 29A:
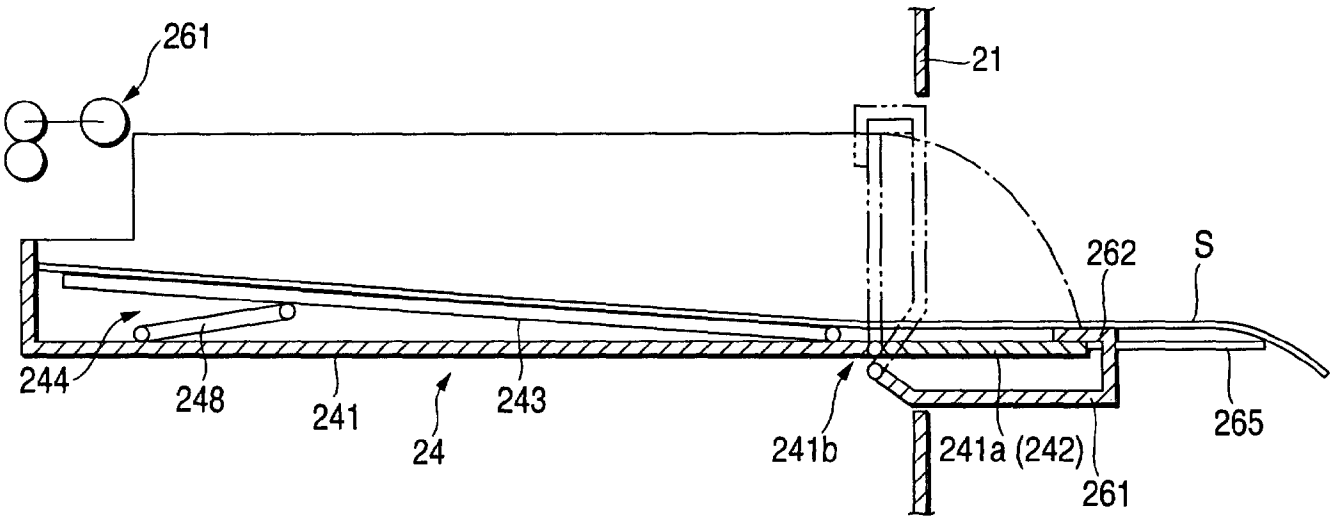
FIG. 29A is an explanatory view showing an example of setting long sheets into the sheet supply unit.

In addition, in the third embodiment, for example, the operation shown in FIG. 29A is carried out for setting the long sheets S on the cassette type sheet supply unit 24. That is, as soon as setting of the extension sheet tray 242 for extension is completed, the bottom plate 243 is moved to the lowest position (initial position). Thus, it is possible to load and receive a sufficient quantity of long sheets S.

Figure 29B:
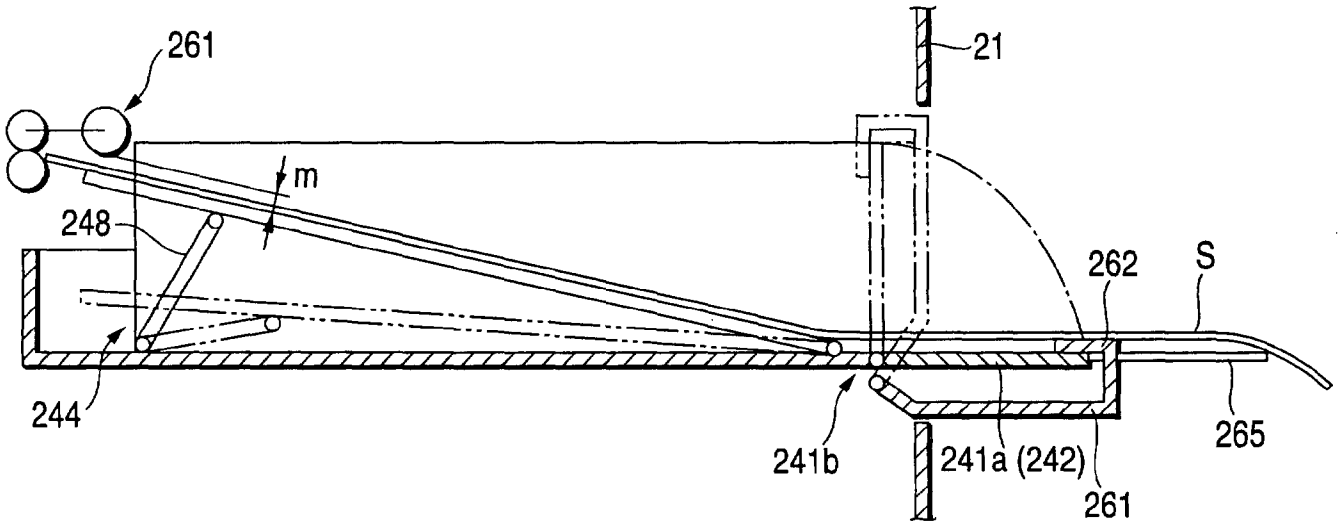
FIG. 29B is an explanatory view showing another example of setting the long sheets.

Alternatively, as soon as setting of the extension sheet tray 242 for extension is completed, the bottom plate 243 may be raised to a predetermined ready position from the lowest position (initial position) so as to reduce a predetermined gap m between the bottom plate 243 and the feeder 61 in advance, as shown in FIG. 29B. Although the job number of long sheets is indeed limited to some extent in this case, the initial gap between the bottom plate 243 and the feeder 61 is reduced so as to reduce the distance with which the long sheets S are raised to be thereby pressed on the feeder 61 at the time of starting printing. Thus, the time required for starting printing can be shortened correspondingly.

Further, in the third embodiment, when both the cover open/close switch 281 and the end guide posture switch 282 are used for detecting whether the extension sheet tray 242 of the cassette type sheet supply unit 24 has been set for extension or not, there is no fear that the long sheet use mode will be executed, for example, even if the open/close cover 261 is opened by accident. Thus, malfunction can be avoided effectively.

Figure 20B:
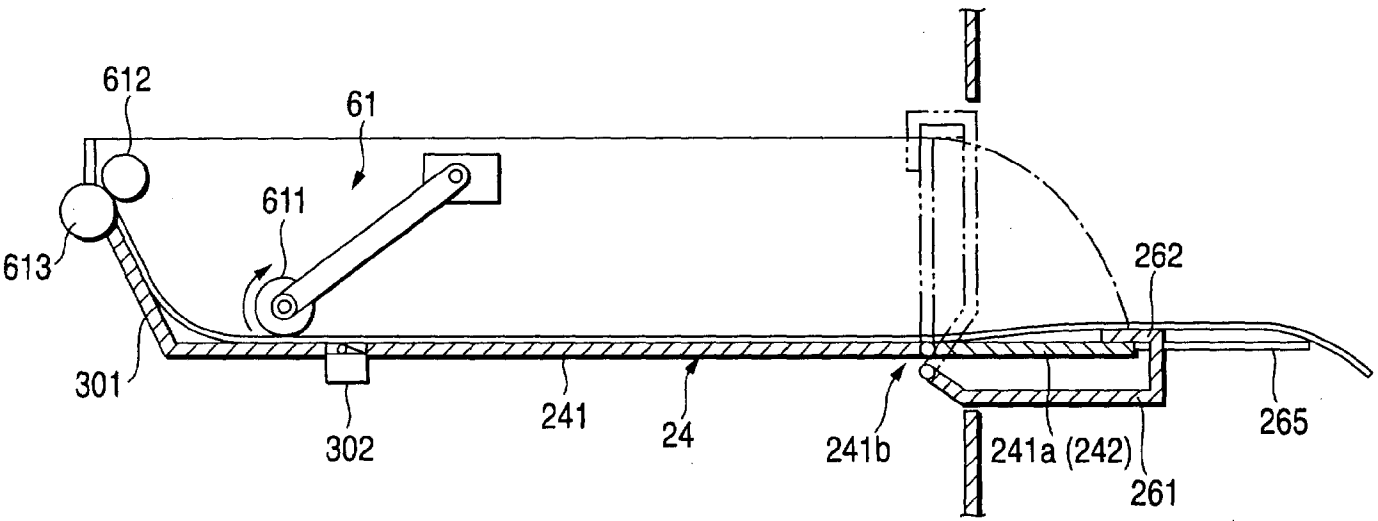
FIG. 20B is an explanatory view showing a modification of the sheet supply unit.

Incidentally, although the third embodiment adopts the form in which the cassette type sheet supply unit 24 includes the bottom plate 243. The invention is not limited to such a form, but another system shown in FIG. 20B may be adopted. For example, an inclined surface portion 301 may be provided on the sheet-feeding-direction side of the cassette body 241. In this case, the sheets S are loaded on the bottom portion of the cassette body 241, while the sheets S are delivered along the inclined surface portion 301 by the nudger roll 611 of the feeder 61, and separated from one another while being managed one by one by the feed roll 612 and the retard roll 613 disposed near the exit of the inclined surface portion 301. Incidentally, the reference numeral 302 represents a sheet presence/absence detection sensor.

Figure 31:
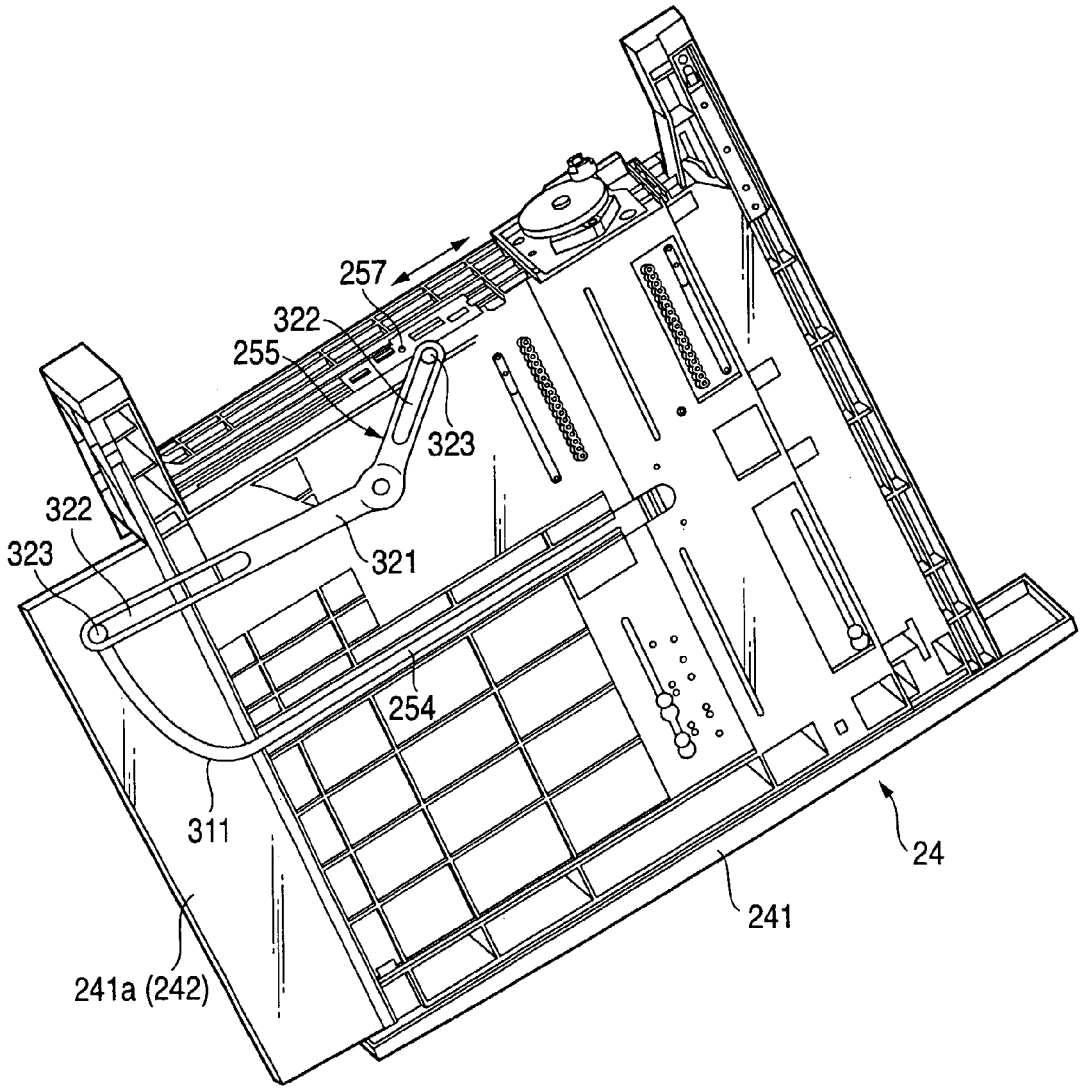
FIG. 31 is a sectional view taken in direction XXXI in FIG. 30.

In addition, another detection system may be adopted for detecting that the extension sheet tray 242 of the cassette type sheet supply unit 24 has been set for extension, for example, as shown in FIGS. 30 and 31. That is, an extension guide slit 311 for the end guide 252 is formed in the extension sheet tray 242 so as to have an arcuate track-like shape. The terminal position of the extension guide slit 311 is set in an area deviating from the area within which the long sheets S should be loaded. On the other hand, the end guide 252 and the end actuator 257 are made to interlock with each other through the link mechanism 255 (for example, a mechanism formed out of a link arm 321 moving a pair of arm portions, and pins 323 slidably joined to engagement slits 322 of the link arm 321). The position of the end actuator 257 when the end guide 252 has moved to the extension guide slit 311 through the guide slit 254 and reached the terminal position of the extension guide slit 311 is detected by a size detection sensor (not shown).

Fourth Embodiment

Figure 32:
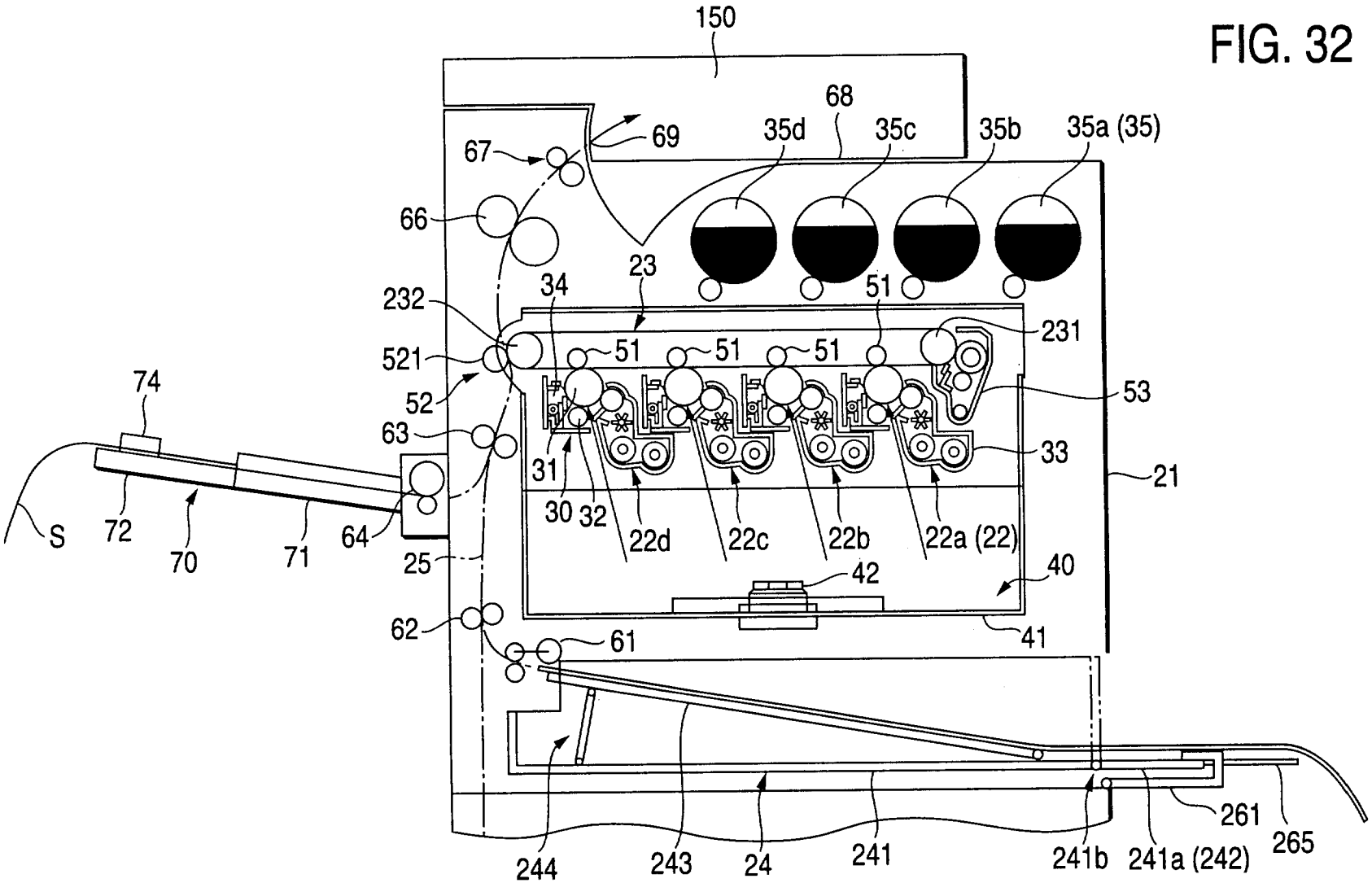
FIG. 32 is an explanatory view showing image forming apparatus as sheet processing apparatus according to a fourth embodiment.

FIG. 32 shows a fourth embodiment of tandem type image forming apparatus as sheet processing apparatus to which the invention is applied.

In FIG. 32, the fundamental configuration of the tandem type image forming apparatus is substantially the same as that in the third embodiment, except that a discharge/reception unit 150 (having a configuration similar to that in the second embodiment) supporting long sheets is detachably attached to the top portion of the body housing 21 instead of the discharge guide unit 130, and further the manual sheet insertion type sheet supply unit 70 is not used as a sheet discharge unit.

Incidentally, constituent components similar to those in the third embodiment are denoted by the same reference numbers as those in the third embodiment correspondingly, and detailed description thereof will be omitted.

In the fourth embodiment, a system similar to the detection system for detecting the attachment/detachment of the discharge guide unit 130 in the third embodiment is used as the system for detecting the attachment/detachment of the discharge/reception unit 150.

Figure 33:
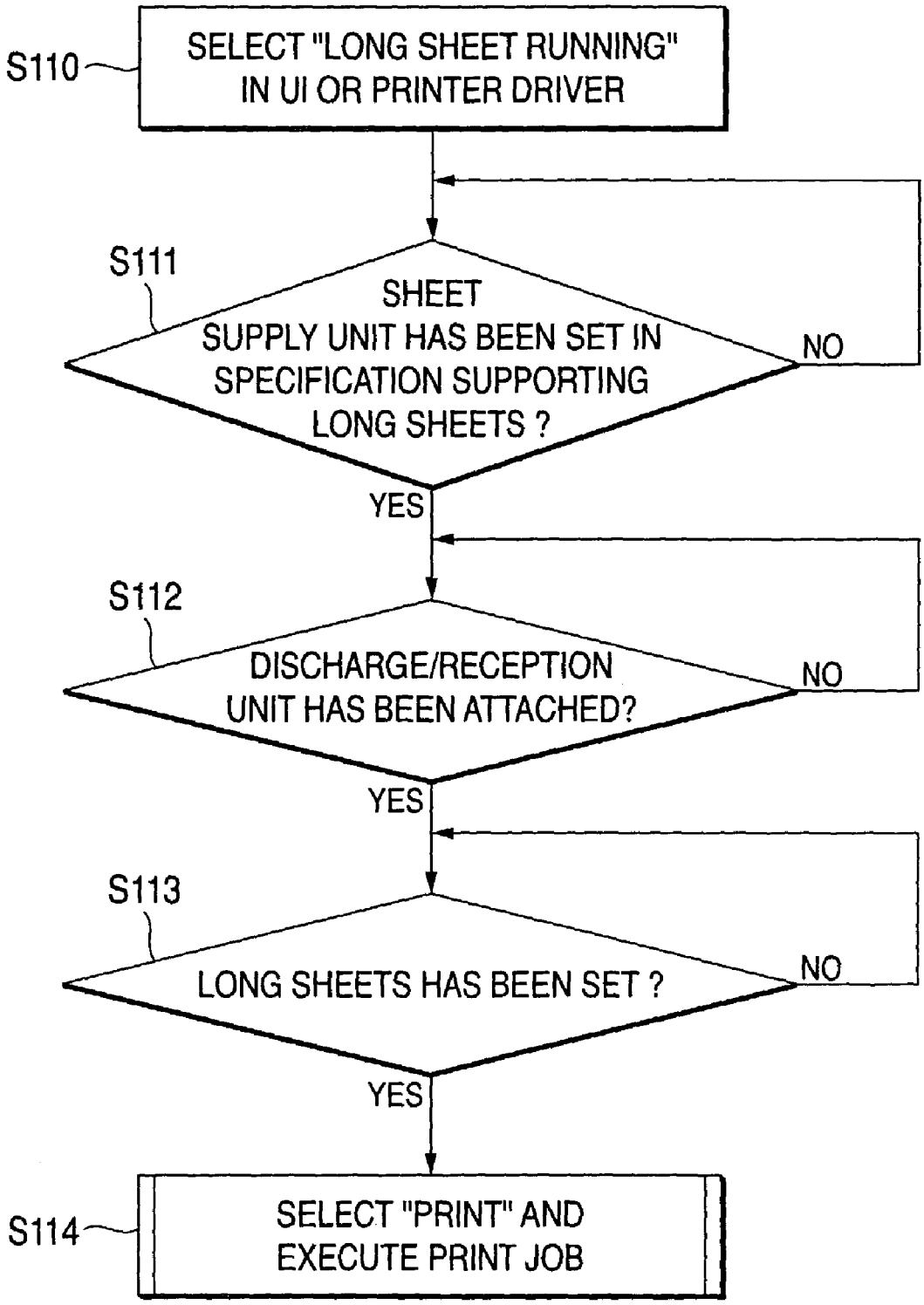
FIG. 33 is a flow chart showing the control/processing procedure thereof.

In addition, a control/processing system used in the fourth embodiment is designed to carry out a print job supporting long sheets, for example, by processing shown in FIG. 33.

Next, description will be made on the operation of the image forming apparatus according to the fourth embodiment.

For example, when a print job using a long sheet is executed, an item "long sheet running" is selected through a UI or a printer driver as shown in FIG. 33 (Step S110).

When such selection is made, the control/processing system checks whether the cassette type sheet supply unit 24 has been set in specification supporting long sheets (Step S111) and whether the discharge/reception unit 150 has been attached (Step S112). Further, the processing/control system checks whether the long sheets S are appropriately set in the cassette type sheet supply unit 24 or not (Step S113).

Then, when an instruction "print" is issued on the property screen of the printer driver after long sheets S are set in the cassette type sheet supply unit 24 in the state where all the check items have been satisfied, a print job is executed on a long sheet (Step S114).

As described above, in a sheet discharge unit according to the invention, a sheet supply tray is also used as a sheet discharge tray, and an area facing the sheet loading surface of the sheet supply tray is used as a sheet discharge surface so as to secure a space for receiving long sheets. Accordingly, no space special to the sheet discharge tray is required for supplying and discharging the long sheets.

It is therefore possible to secure the long sheet reception property without requiring an extra reception space. Thus, it is possible to enhance the reliability in handing the long sheets.

In addition, in sheet processing apparatus using such a dual-purpose type sheet discharge unit, a detachable discharge guide unit may be used for guiding and discharging the long sheets. Thus, in a condition to use the long sheets, the long sheets can be supplied and discharged effectively. On the other hand, in a condition not to use the long sheets, the operation of discharging regular sheets can be supported easily by detaching the discharge guide unit.

Further, in a sheet discharge unit according to another form of the invention, a discharge/reception unit supporting long sheets is provided detachably as all or a part of the sheet discharge unit. Accordingly, in a condition to use the long sheets, a long sheet reception property can be secured without requiring an extra reception space. Thus, the reliability in handing the long sheets can be enhanced. On the other hand, in a condition not to use the long sheets, the operation of discharging regular sheets can be supported easily by detaching the discharge/reception unit.

Furthermore, in sheet processing apparatus using such a sheet discharge unit, the long sheet reception property in the sheet discharge unit can be stabilized. Thus, the performance of processing the long sheets can be kept in good condition.

In addition, in a sheet supply unit according to the invention, an extension sheet tray is provided extensibly with respect to a standard sheet tray, and it can be detected by an extension detection unit whether the extension sheet tray has been set for extension or not. Accordingly, the property of receiving long sheets can be stabilized, while it can be recognized accurately whether the sheet supply unit has been set in a state corresponding to a long sheet use mode. Thus, the reliability in handling the long sheets can be enhanced correspondingly.

Further, in sheet processing apparatus using such a sheet supply unit, the property of receiving long sheets in the sheet supply unit can be stabilized, while it can be recognized accurately whether the sheet supply unit has been set for extension in order to support long sheets. Thus, the performance of processing the long sheets can be kept in good condition.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. An image processing apparatus comprising:

an image forming engine;

a standard sheet tray that accommodates a sheet having a standard size, and supplies the sheet to the image forming engine, the standard sheet tray being provided to be extendable in an upstream direction with respect to a sheet conveying direction to accommodate a long sheet and supply the long sheet to the image forming engine; and a discharge tray that receives the sheet on which an image is formed by the image forming engine and discharged from the image processing apparatus, the discharge tray is connected to a feeder that is configured to supply the sheet to the image forming engine;

a discharge guide unit that is detachably provided on the image processing apparatus and guides the long sheet discharged from the image processing apparatus towards the discharge tray by changing a conveying direction of the long sheet; and an extension detection unit that detects whether or not the standard sheet tray is extended, wherein the standard sheet tray does not support one end of the long sheet in a state where the standard sheet tray is extended, and wherein the long sheet has a length longer than that of a sheet accommodatable by the standard sheet tray in a state where the standard sheet tray is retracted, wherein a processing control unit detects whether or not the discharge guide unit is attached to the image processing apparatus.

2. An image processing apparatus comprising:

an image forming engine;

a standard sheet tray that accommodates a sheet having a standard size, and supplies the sheet to the image forming engine, the standard sheet tray being provided to be extendable in an upstream direction with respect to a sheet conveying direction to accommodate a long sheet and supply the long sheet to the image forming engine; and a discharge tray that receives the sheet on which an image is formed by the image forming engine and discharged from the image processing apparatus, the discharge tray is connected to a feeder that is configured to supply the sheet to the image forming engine;

a discharge guide unit that is detachably provided on the image processing apparatus and guides the long sheet discharged from the image processing apparatus towards the discharge tray by changing a conveying direction of the long sheet;

an extension detection unit that detects whether or not the standard sheet tray is extended and a processing control unit that detects whether or not the discharge guide unit is attached to the image processing apparatus, wherein the standard sheet tray does not support one end of the long sheet in a state where the standard sheet tray is extended, and wherein the long sheet has a length longer than that of a sheet accommodatable by the standard sheet tray in a state where the standard sheet tray is retracted, further comprising a controller that controls the image forming engine to perform an image forming process in a long sheet mode according to the extension of the standard sheet tray and the attachment of the discharge guide unit being detected by the extension detection unit and the processing control unit, respectively.

* * * * *